US009415324B2

(12) United States Patent
Shaanti

(10) Patent No.: US 9,415,324 B2
(45) Date of Patent: Aug. 16, 2016

(54) CONSTRUCTIVE MUSIC

(71) Applicant: Rohan Shaanti, Toronto (CA)

(72) Inventor: Rohan Shaanti, Toronto (CA)

( * ) Notice: Subject to any disclaimer, the term of this patent is extended or adjusted under 35 U.S.C. 154(b) by 0 days.

(21) Appl. No.: 14/466,048

(22) Filed: Aug. 22, 2014

(65) Prior Publication Data

US 2016/0030854 A1 Feb. 4, 2016

Related U.S. Application Data

(60) Provisional application No. 62/032,694, filed on Aug. 4, 2014.

(51) Int. Cl.
*A63H 5/00* (2006.01)
*A63H 33/04* (2006.01)

(52) U.S. Cl.
CPC ..... *A63H 33/04* (2013.01)

(58) Field of Classification Search
USPC ..... 446/71, 81, 397, 404, 418, 419, 421, 446/408; 84/470 R, 476
See application file for complete search history.

(56) References Cited

U.S. PATENT DOCUMENTS 491,833 A * 2/1893 Bowen ..... G09B 15/026 84/404
2,879,685 A * 3/1959 Page ..... G09B 15/00 84/330
3,005,282 A 10/1961 Christiansen
3,757,393 A * 9/1973 Bucheli ..... A63H 33/06 24/457
3,852,909 A * 12/1974 Viebcke ..... A63H 33/065 446/121
4,651,613 A * 3/1987 Harrison ..... G10F 1/06 434/159
4,924,743 A * 5/1990 Tsai ..... G09B 5/04 84/476
4,936,185 A * 6/1990 Yamaguchi ..... G10H 1/32 200/52 R
6,132,281 A * 10/2000 Klitsner ..... A63H 33/042 446/397
6,271,453 B1 * 8/2001 Hacker ..... G09B 15/003 434/171
6,353,168 B1 * 3/2002 Sosoka, Jr. ..... G10H 1/0008 446/397
7,238,026 B2 * 7/2007 Brown ..... G09B 5/06 434/258
7,956,271 B1 * 6/2011 Jonas ..... G09B 15/00 84/476
8,420,923 B1 * 4/2013 Choi ..... G10H 1/32 84/476
8,779,263 B2 * 7/2014 Sallee ..... G10D 13/06 446/85
9,108,114 B2 * 8/2015 Goh ..... A63H 3/28
2003/0139113 A1 * 7/2003 Wood ..... A63H 30/00 446/175
2006/0252340 A1 11/2006 Bach et al.
2008/0220690 A1 9/2008 Munch
2013/0165012 A1 * 6/2013 Klauber ..... A63H 33/062 446/91
2014/0106643 A1 * 4/2014 Powers ..... A01M 31/004 446/418

* cited by examiner

*Primary Examiner* — Kurt Fernstrom
(74) *Attorney, Agent, or Firm* — Nasser Ashgriz UIPatent Inc.

(57) ABSTRACT

Musical toy building elements to make a plurality of combination of sounds comprising of a plurality of walls, a top lid and a bottom cap to make an inner space between them, wherein at least two of said walls, said lid and said cap having releasable couplers, and wherein said releasable couplers selected from a group of male and female couplers, hook and loop couplers or magnetic connectors, and wherein said block having percussion musical instruments to produce sounds, said musical instrument being installed on the lid, or on the walls or in the inner space of the block and said musical instrument being detachably mounted on the block or being an integral element of the building block.

19 Claims, 31 Drawing Sheets

CONSTRUCTIVE MUSIC

RELATED APPLICATION

The present application claims the priority date of provisional patent application No. 62/032,694 filed Aug. 4, 2014.

FIELD OF THE INVENTION

The present invention relates to buildable instruments having coupling means while being able to make different sounds.

BACKGROUND OF THE INVENTION

Different types of toy bricks or blocks are available, which are used to build a variety of structures. These bricks or building blocks have different coupling means, different sizes and shapes. For instance, LEGO, K'NEX and MEGA BLOKS brands provide a variety of designs attempting to motivate children and adults to develop new ideas and concepts with the help of building elements. Novel concepts are being implemented on these building blocks. For instance, there is a toy building block that makes a doorbell sound.

SUMMARY OF THE INVENTION

The present invention is a musical instrument that is constructible and de-constructible by a user. The present invention incorporates a variety of musical instruments, such as Shakers, Tambourine Jingles, Bells, Xylophones, Glockenspiel, Thumb-pianos, Guiros, Tone-blocks, Drums, Cymbals, and Clackers. The present invention has the ability to be built into different shapes and forms, and can function as many different instruments that can work individually or simultaneously with each other.

The building instruments of the present invention have other attaching means to connect to each other or external devices, such as straps. Attachment means such as Velcro, clips, strings, magnets, grooves, loops & buttons are used to attach the present device to each other or other external surfaces.

The present invention promotes creativity and imagination, letting a user makes different musical instruments and composes music with their own original sounds. These elements can be used to teach users how music is produced and how different kinds of sound making material can affect each other. By having such musical elements, users can compose their own music and invent different kinds of sound combinations.

This invention has been designed to teach the principles of music composition and to help with music development for users of all ages.

It can be used in many areas of a sound and music school curriculum or music therapy, at a recording studio and for live musical performances.

The present invention is great for developing social collaboration between users and for encouraging them to use music language. It helps children develop a deeper understanding of different musical instruments and a further knowledge of how sounds are produced based.

The present invention allows users to experiment with different materials, letting them mix and produce new sounds.

The present invention is used by novice and professional musicians who can attach percussion sounds and instruments to their limbs, such as leg or arm, while they play another instrument, such as guitar, violin or piano.

The present invention is used by dancers who can attach the devices to their arms, legs, hips, hands and feet. As they dance they move the desired instrument. This movement shakes the instruments, making a sound. The present invention allows for users to make their limbs into adjustable and interchangeable instruments.

Building Instruments can also be attached to other devices such as elasticised or non-elasticised straps which have corresponding Velcro, clips, fasteners, string fasteners, magnets, grooves, loops & buttons. These straps can be mounted to a user's foot, leg, knee, arm, hand, chest or head. As well, these straps can also be mounted onto other existing instruments or devices, such as a hand-held tambourine or a microphone stand.

When mounted to the body the attached instruments make sounds when the user shakes a limb supporting the instruments.

When mounted to an instrument, the attached instruments make sounds when the user shakes the instrument.

Building instrument make sounds when struck with a stick, or hitting device.

It is the first objective of the present invention to provide a device for users to become systematically creative music learners. This can be done by combining different types of musical instruments with playfulness and imagination, giving form to their thoughts of musical sound ideas.

It is the second object of the present invention to provide a device for users to become active instrument builders by constructing musical instruments in the real world with combinations of instruments that are specific to the sound they are trying to achieve. While combining objects, users learn how sounds are produced, how instruments are made, how various materials affect sound, and how different combinations of instruments and instrument materials sound together.

It is another object of the present invention to provide a device for users to become collaborative learners by helping each other become involved in composing a musical piece.

It is another object of the present invention to provide disabled users the opportunity to make musical sounds by moving their limbs.

It is another objective of the present invention to provide elderly users the opportunity make musical sounds by moving their limbs.

It is another object of the present invention to provide all users with the ability to wear a variety of interchangeable musical instruments for aesthetic means.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE DRAWINGS

Figure 1:
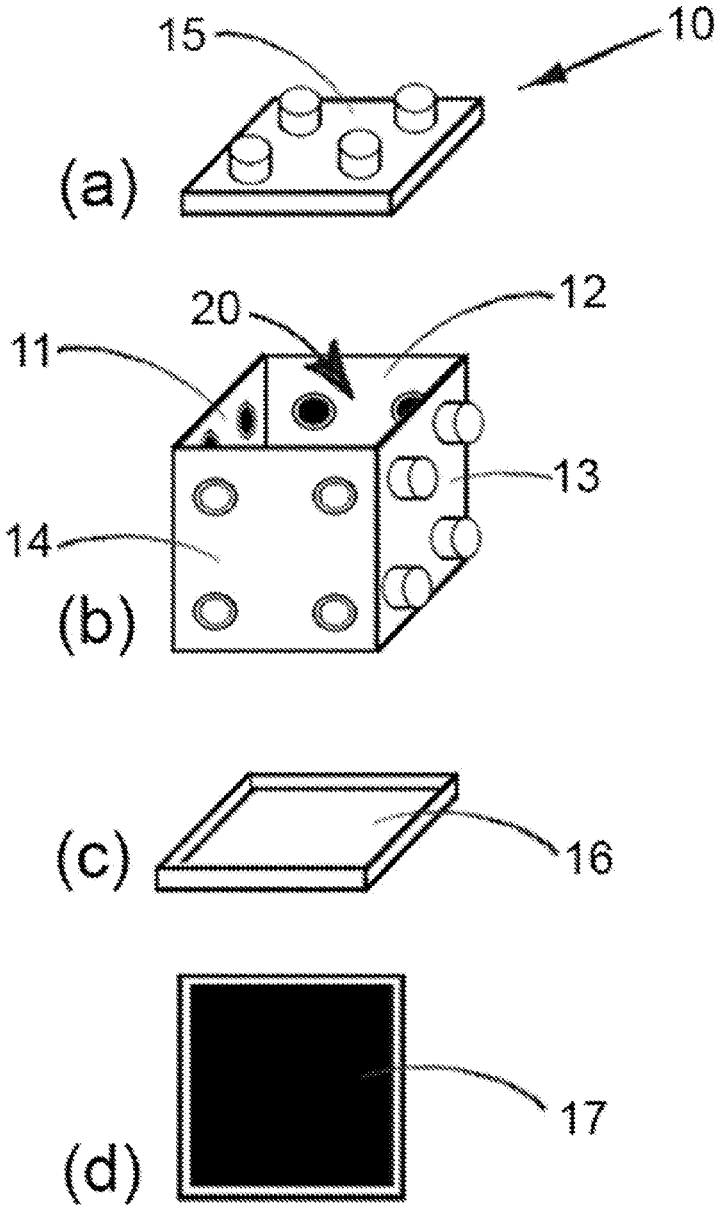
FIG. 1 shows exploded view of an example of a toy brick.

A traditional building block element is shown in FIG. 1. The building block 10 comprises of four walls 11-14 and two lids 15-16 to make a space 20 between four walls 11-14 and two lids 15-16. The walls 11-14 can be selected from a group of a male connecting wall 13, a female connecting wall 11, a Velcro wall 17, a magnetic wall 12 to construct a narrow space 20. The lids 15-16 can be selected from a group of a male connecting wall 15, a Velcro wall 17, and a simple wall 16 to construct a narrow space 20.

Figure 2:
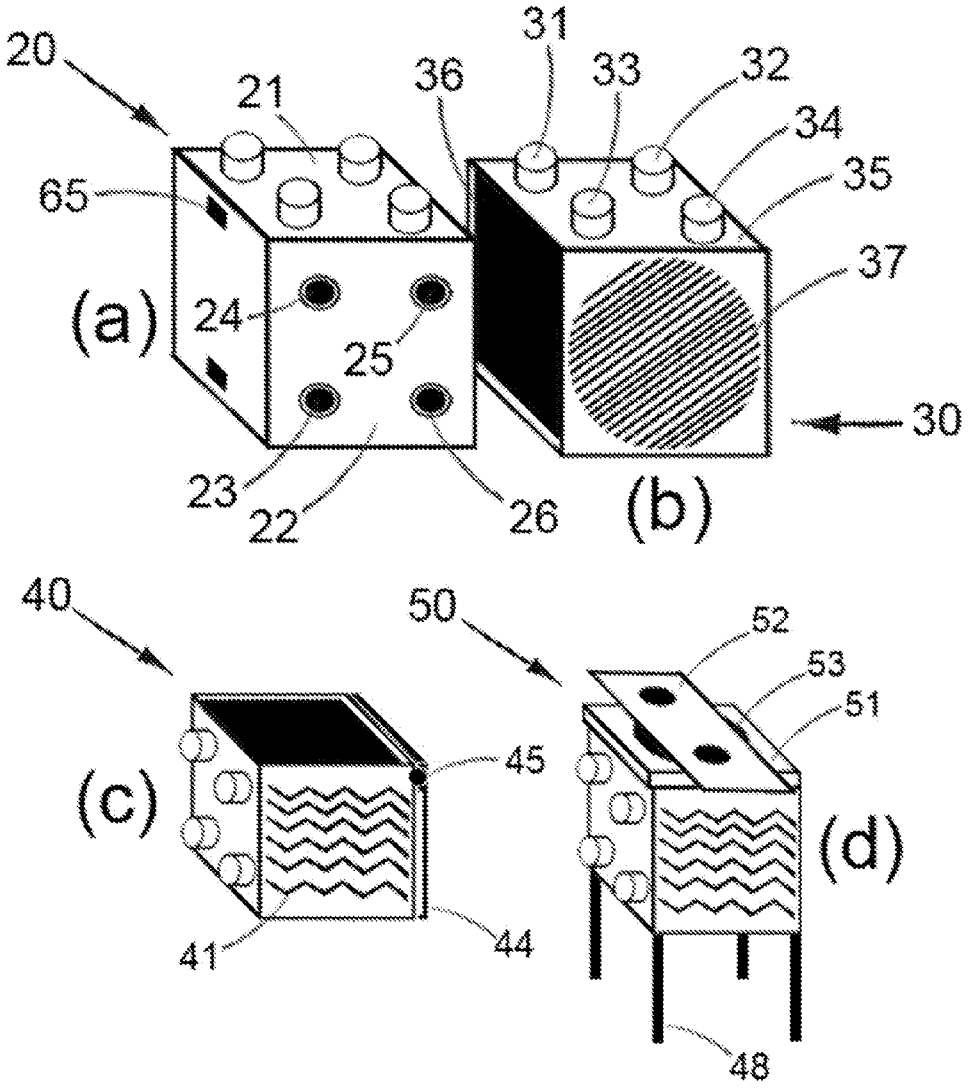
FIG. 2 shows an example of enclosed blocks with six walls combined with internal instruments, aperture, clips, and legs.

Musical building blocks with instruments permanently enclosed are shown in FIG. 2. A building block 20 with a male connecting clips 21 and a female connecting clips 22. The diameter of the holes 23-26 in the female connecting wall 22 are adapted to receive male parts 31-34 of the male connecting wall 35. As shown in FIG. 2 (*b*), there are different connection methods designed in walls 35-37 of a building block 30. The wall 36 is equipped with a Velcro to help the building block 30 to attach to a receiving Velcro surface on another block or fabric. Wall 37 is equipped with a magnet to help the building block 30 attach to the metallic surface or other building blocks with a magnetic wall.

As shown in FIG. 2 (*c*), there is a wall 41 with a jagged face. As shown in FIG. 2 (*d*), an element 52 of a xylophone instrument connected over a hole 53 of the building block 50. As shown in FIG. 2 (*c*) clips 44 or spring clips 45 may be embodied on the wall to help user attach instrument to clothing or external surfaces.

As shown in FIG. 2 (*d*) legs 48 may be embodied to helps block vibrates when hit, allowing for a cleaner sound when using instruments that require hitting, such as Xylophone and Tone-block.

Figure 3:
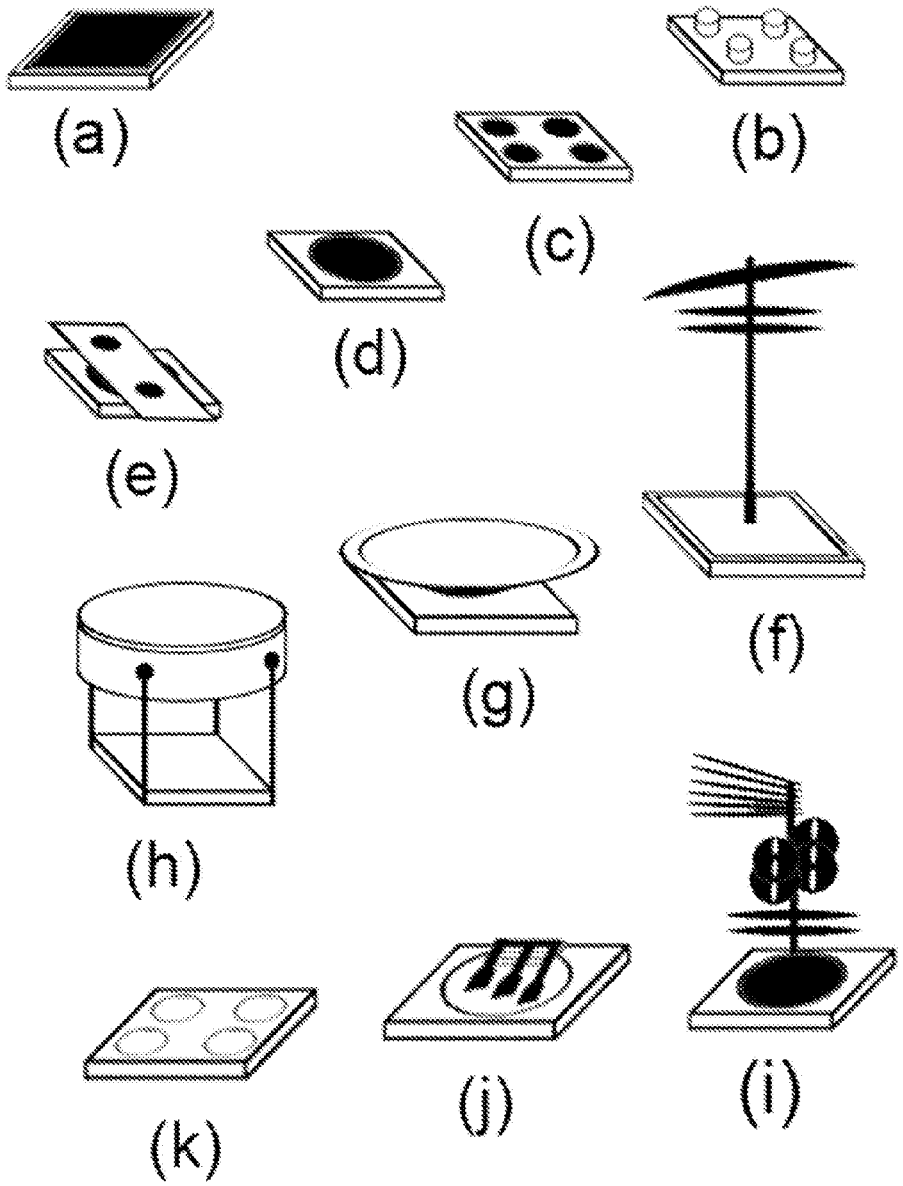
FIG. 3 shows an example of different lids for a toy instrument.

As shown in FIG. 3, the building block can have different lids which help it to connect to other building blocks or act as a part of a musical instrument. Different building block lids are shown in FIG. 3 (*a-i*) such as a lid which is equipped with Velcro in FIG. 3 (*a*), male connection in FIG. 3 (*b*), female connection in FIG. 3 (*c*), a lid equipped with a magnet in FIG. 3 (*d*), Xylophone element in FIG. 3 (*e*), metal jingles element in FIG. 3 (*f*), cymbal element in FIG. 3 (*g*), drum element in FIG. 3 (*h*), clacker, bell, & jingle element in FIG. 3 (*i*), thumb piano in FIG. 3 (*j*), and a lid with holes in FIG. 3 (*k*).

The xylophone building element is a percussion musical instrument that comprises of wooden or metallic bars struck by mallets. Each bar tuned to a pitch of a musical scale, in pentatonic, heptatonic, diatonic or chromatic based on the shape and configuration of the bars. When struck by a drumstick, mallet, fingers, or any other object, the bars vibrate, creating a sound. Longer bars produce lower pitched sounds while smaller bars create higher pitched sounds. Xylophone bars can be mounted onto the body of the building element or made within the fabric of a block. Xylophone bars may be permanently installed on a music block of the present invention or made as a detachable attachment of the present invention. Xylophone instruments of the present invention may mount to external surfaces with or without the support of a building block frame.

The tambourine building element is a percussion musical instrument comprising of small metal jingles that can be mounted inside the space of the building block. A jingle is a rattle consisting of a small metallic, plastic, wooden or copper disc that makes sounds when they collide with each other.

Tambourines of the present invention are made up of jingles that are loosely mounted to a pin. When shaken, the jingles hit each other, creating a sound. Larger jingles produce lower tone notes while smaller jingles make a higher tone notes. Different metals or materials that make up the jingles will influence the sounds they produce. Tambourine jingles can be mounted onto the body of the building block of present invention or inside the body of the present invention or onto external surfaces without the support of building block frame.

Figure 4:
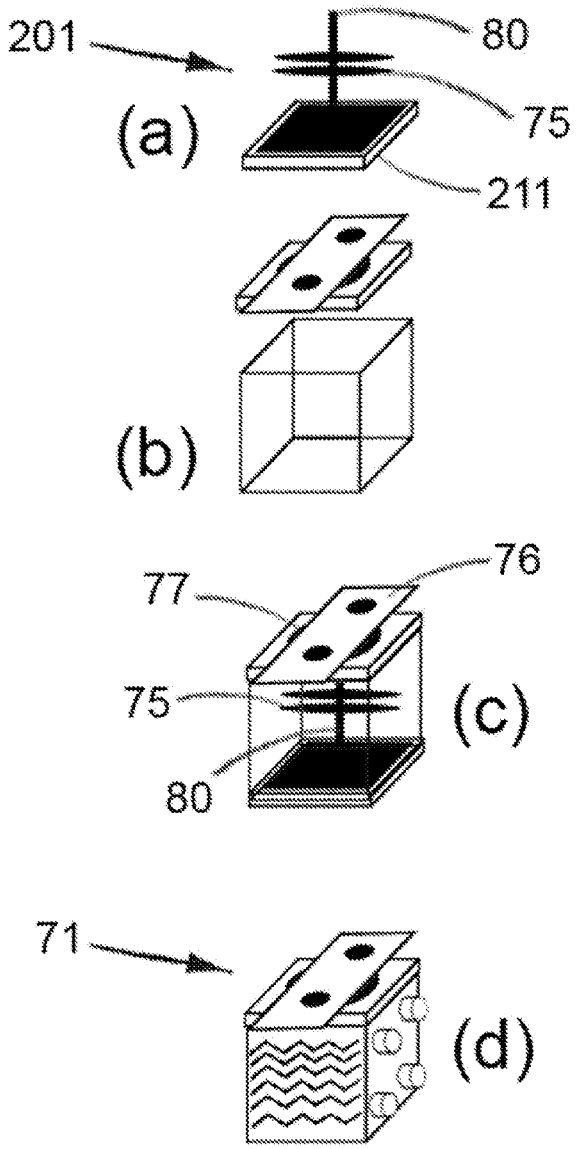
FIG. 4 shows exploded view of an example of a toy instrument having different attachments.

As shown in FIG. 4 (*a*), a tambourine Assembly 201, with a Velcro base 211, Jingles 75, and a Pin 80 can be mounted onto an external surface without the support of a block frame. As shown in FIG. 4, the musical building block 71 comprises of a pair of small metal jingles 75 which are loosely mounted to a pin 80. A metallic or wooden bar 76 is connected to the building block 71 with a lid 77. The building block 71 resembles a musical instrument combining of a Xylophone and a tambourine instrument.

Bells of the present invention consist of small balls contained within a metal sphere. When shaken, the ball hits the sphere, vibrating it and creating a musical sound. Larger metal spheres create a lower pitched sound while smaller metal spheres create a higher pitched sound. Bells can be mounted onto or inside the body of the building blocks of present invention or onto external surfaces without the support of block frame.

Figure 5:
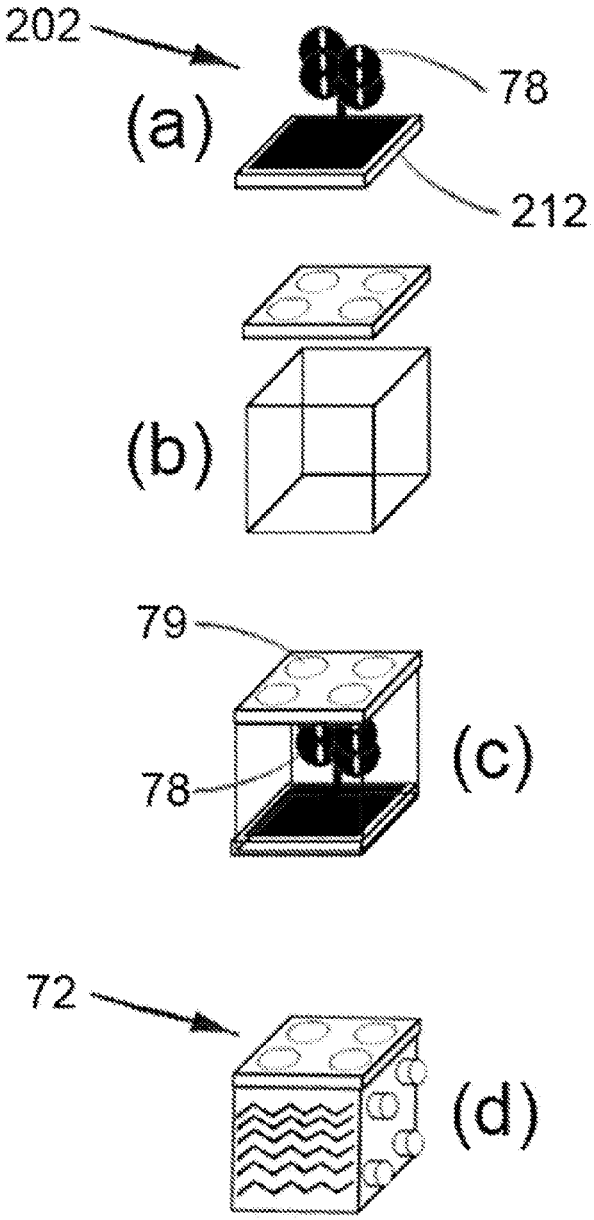
FIG. 5 shows exploded view of an example of a toy instrument having different attachments.

As shown in FIG. 5 (*a*) a bell assembly 202, with a Velcro base 212, can be mounted onto an external surface without the support of a block frame. As shown in FIG. 5 (*a-d*), the bell building element 202 is a percussion instrument and an idiophone that comprises of cup-shaped acoustic resonator 78, which vibrates upon being struck. The striking implement is a small loose sphere enclosed within the body of the bell. Bells are usually made of various metals, copper, ceramic or glass. Holes 79 allow for sound to travel outside the enclosed walls of the block. The building block 72 resembles a musical instrument combining of a bell instrument.

Clackers of the present invention are made from a series of plates that are bound together on one end and open on the other end. When shaken or moved, the open side of the plates hit each other, creating a sound. Larger plates make lower pitched sounds while smaller plates make higher pitched sounds. Clackers can be mounted onto or inside the body of the building block of present invention. Two or more blocks may also share one set of clackers to create a unique playing style. Two or more clackers may also share one block to create a unique playing style. Clackers may be mounted onto external devices without the support of a block.

Kalimba of the present invention is an idiophone instrument that requires user to pluck metallic pegs which are over a hole. The pegs are mounted together and tightened on one end. Plucking side of pegs are facing the user and are free from fasteners. The user can make sounds by applying pressure to the plucking side of peg with finger or thumb, and then releasing it. The vibration of peg makes a sound and may get amplified if mounted to a block. Larger pegs produce lower sounds while smaller pegs produce higher sounds. Size of block may influence sound production. Instrument within block may also influence sound produced by instrument.

Figure 6:
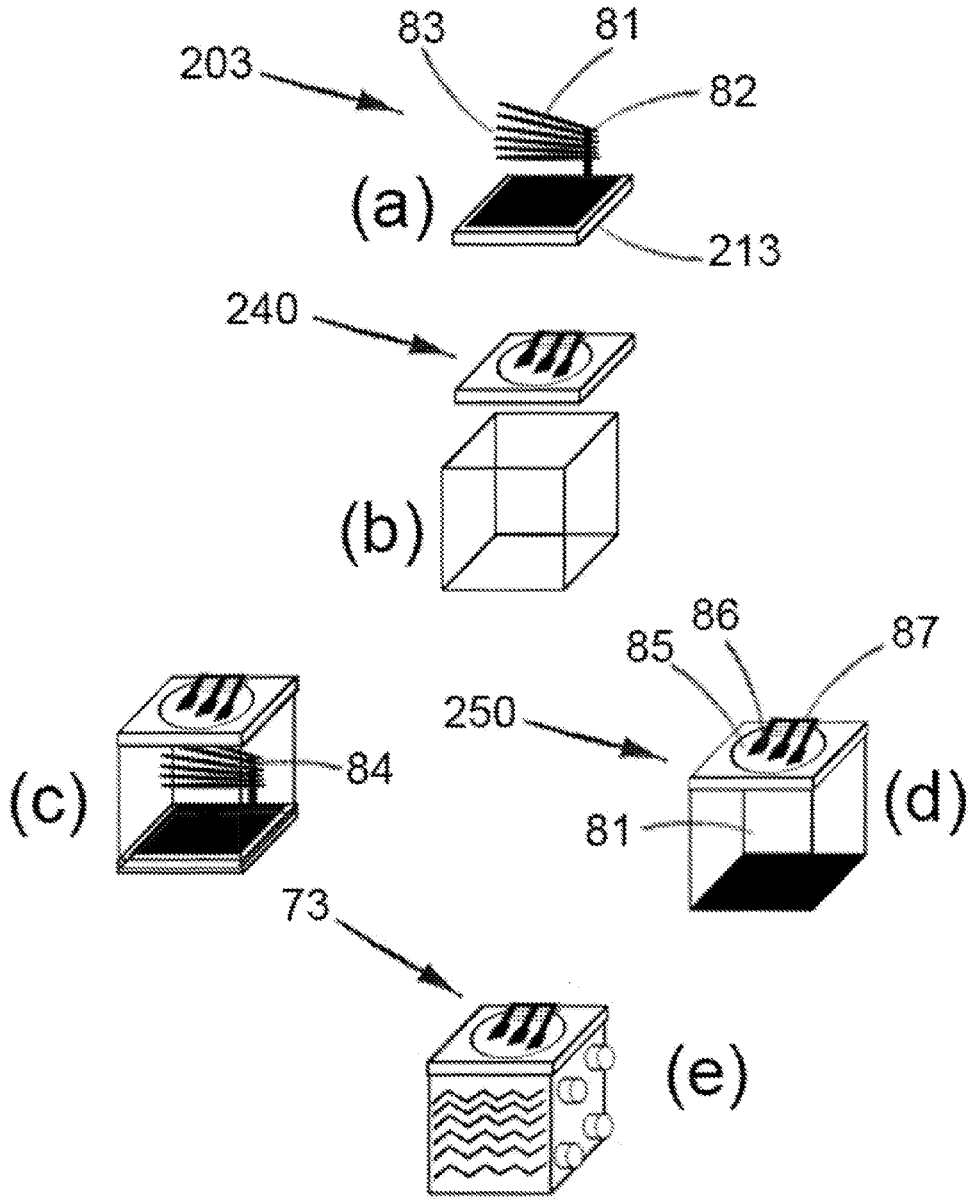
FIG. 6 shows exploded view of an example of a toy instrument having different attachments.

As shown in FIG. 6 (*a-d*), the clacker building element 203 is a percussion instrument and that comprises of a series of plates 81 that are bound together on one end 82 and open on the other end 83. When shaken or moved, the open side 83 of plates 81 hit each other, creating a sound. Hole 85 designed in the wall allows sound to travel outside the enclosed walls of the block.

As shown in FIG. 6 (*b-e*) a Thumb-piano or Kalimba building element 240 is attached to a block building element. The building block 73 resembles a musical instrument combining a clacker instrument and a Thumb-piano is shown in FIG. 6 (*e*).

A shaker building element can be described as a percussive musical instrument used for creating rhythm in music. The method of creating the sound involves shaking and moving the building element back and forth. The shaker building element comprises a container, partially full of small loose objects such as beads, pebbles or beans which create the percussive sounds as they collide with each other and the container.

Figure 7:
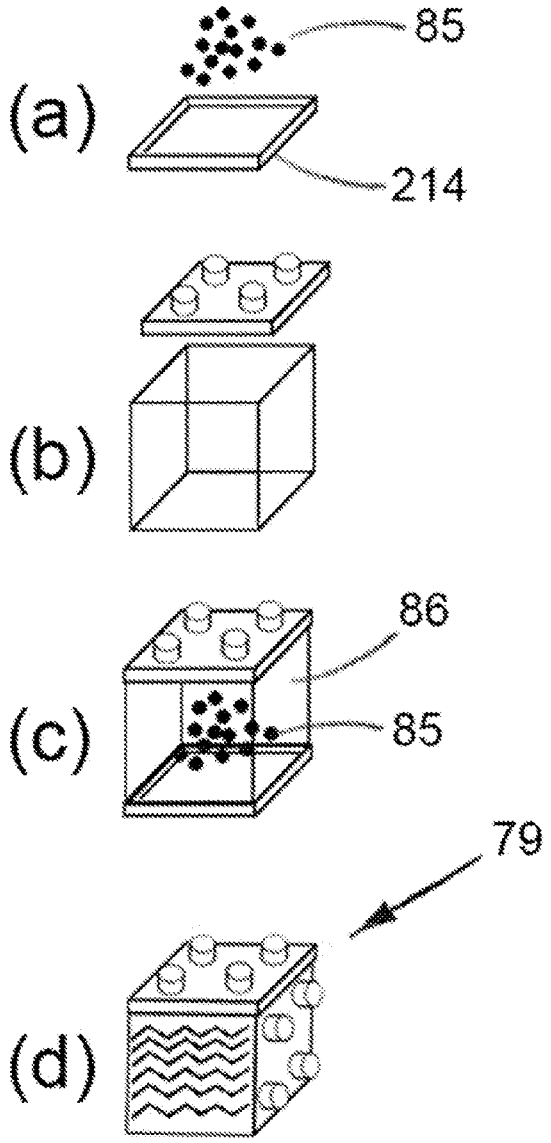
FIG. 7 shows exploded view of an example of a toy instrument having different attachments.
Figure 15:
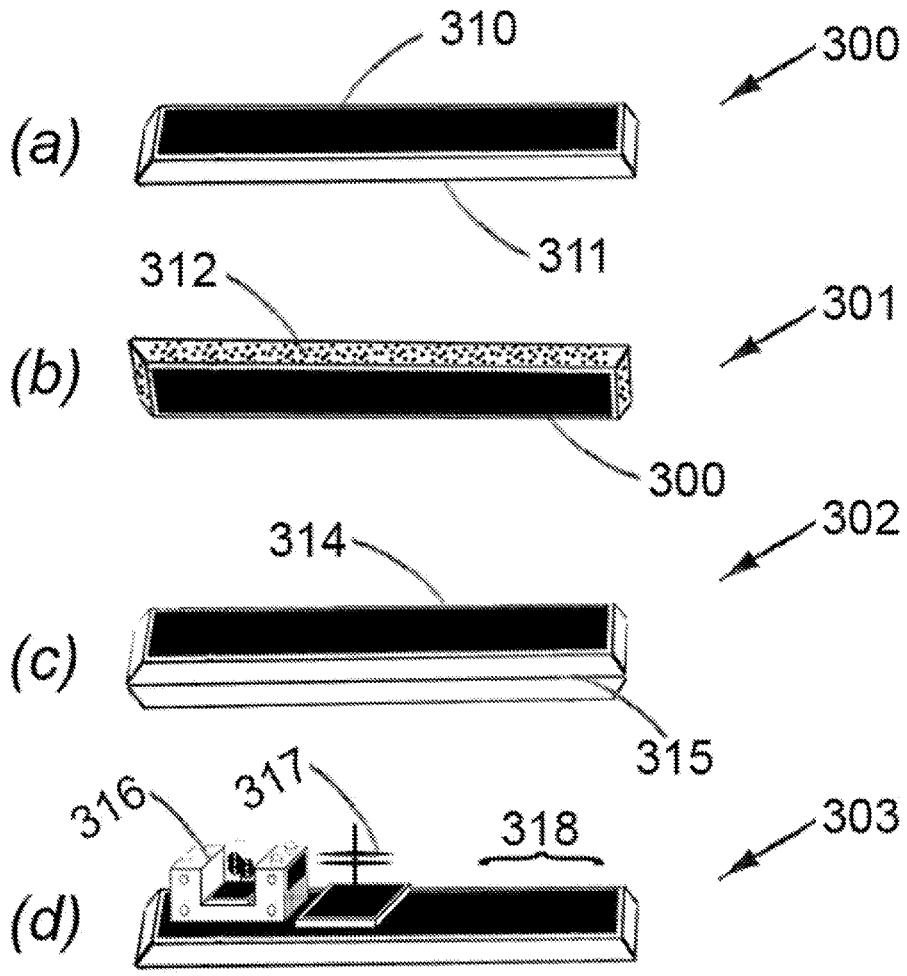
FIG. 15 shows a toy instrument shaped like a flat rectangle.
Figure 24:
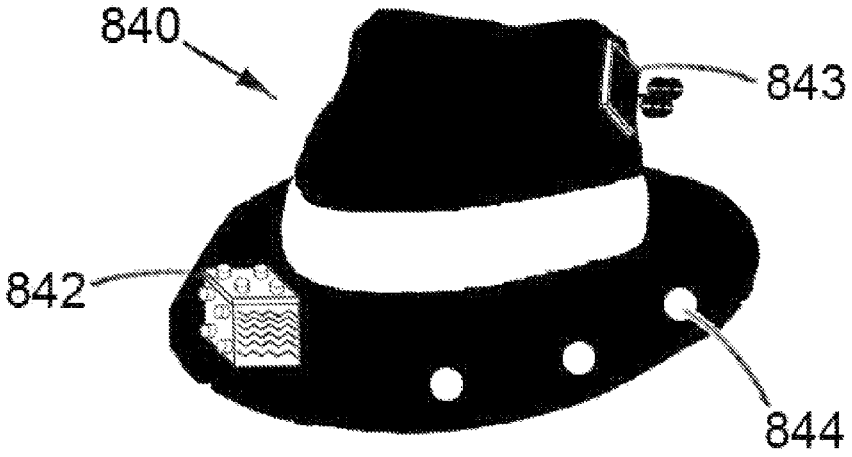
FIG. 24 shows an example of a hat used to mount toy instruments.

As shown in FIG. 7 (*a-d*), the shaker building element is a percussion instrument made from beads, beans, seeds, dried grains or sand 85 which are inside a building block 79. Sounds are made when this building block 79 is shaken and the contents inside collide with each other and the walls of the block. A larger housing unit creates lower pitched sounds, while smaller housing creates higher pitched sounds. Different materials used for the block walls and the contents within the block let the instrument produce different sounds as well. Shakers can be mounted onto or inside of the body of the building block of present invention. Shakers can also be permanently encased within the fabric of a block, as shown in FIG. 15 (301), FIG. 16 (402), and FIG. 17 (501). Shakers may also be mounted onto users, as illustrated in FIG. 24 (912) and external instruments, as illustrated in FIG. 24 (908) and FIG. 25 (945).

Figure 8:
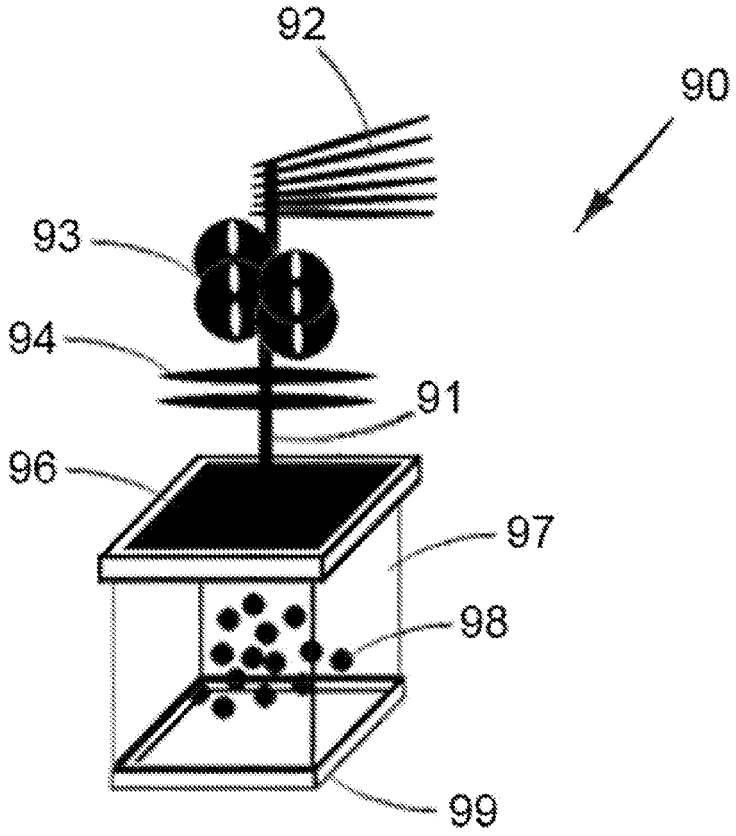
FIG. 8 shows an example of a toy instrument having different attachments.
Figure 25:
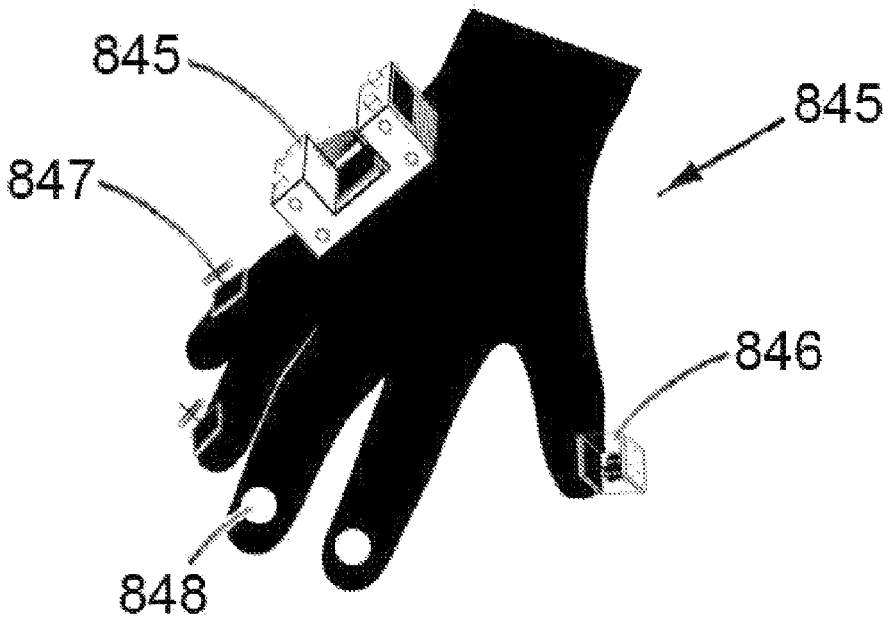
FIG. 25 shows an example of a glove used to mount toy instruments.

As shown in FIG. 8, the building element 90 is a percussion instrument that comprises of multiple different instruments. As shown in FIG. 8, there is a small rod 91 which connects clackers 92, bells 93, and tambourine jingles 94 together and inside the building block 90 has small loose objects such as beads, pebbles or beans which create percussive sounds as they collide with each other and the building block 90. The combination of these four instruments can be used to make a unique sound. The combination of these sounds may be adjusted further if the user decides to remove instruments from the assembly. The user can adjust the music assembly by removing rod and unfastening the desired instrument. The base of this instrument has Velcro fasteners 99 that can mount on to a user or external surface, as illustrated in FIG. 25 (943).

Cymbals of the present invention are made from metallic discs that are attached to a block. Sounds are made by hitting a single cymbal or by hitting two cymbals together. The cymbals produce a sound as they vibrate after being hit. Larger cymbals produce lower pitched sounds while smaller cymbals produce higher pitched sounds. Finger cymbals can be mounted onto the body of the building block of the present invention. Finger cymbals may also be permanently installed on the body of the present invention.

Figure 9:
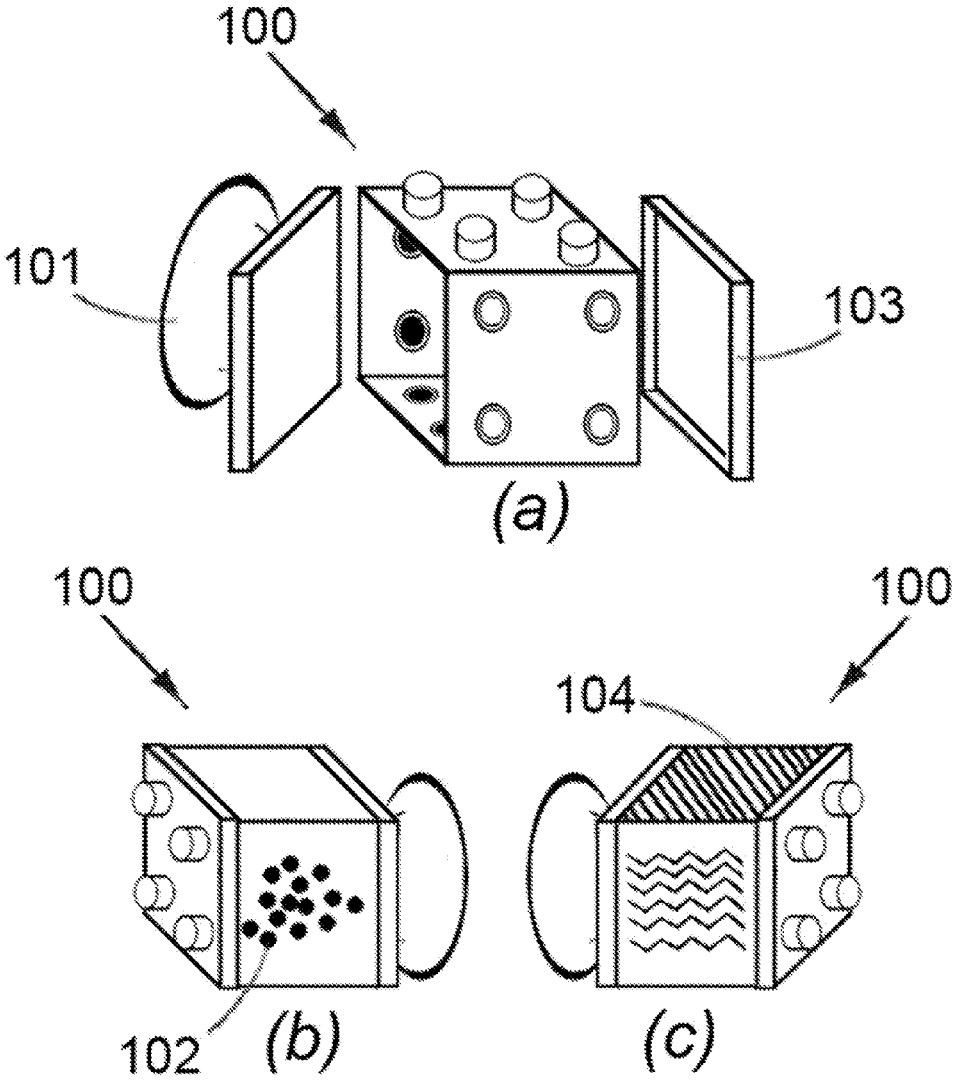
FIG. 9 shows exploded view of an example of a toy instrument with different lids and walls.

As shown in FIG. 9 (*a-c*), cymbals of the present invention are round metallic disks 101. When hit with another cymbal, or hit with a stick, finger, or any other solid object, the cymbal vibrates and makes a sound. Larger cymbals make lower pitched sounds while smaller cymbals make higher pitched sounds. Different metallic materials that make up the cymbal will influence the sound the instrument produces. Cymbals can be mounted onto the body of a block or be permanently installed on the body of a building block.

FIG. 9 (*b*) shows a cymbal building block with small loose objects such as beads, pebbles or beans that resemble a shaker, this building block 100 combines shakers and cymbals together to make a unique sound with multiple usability options.

Figure 10:
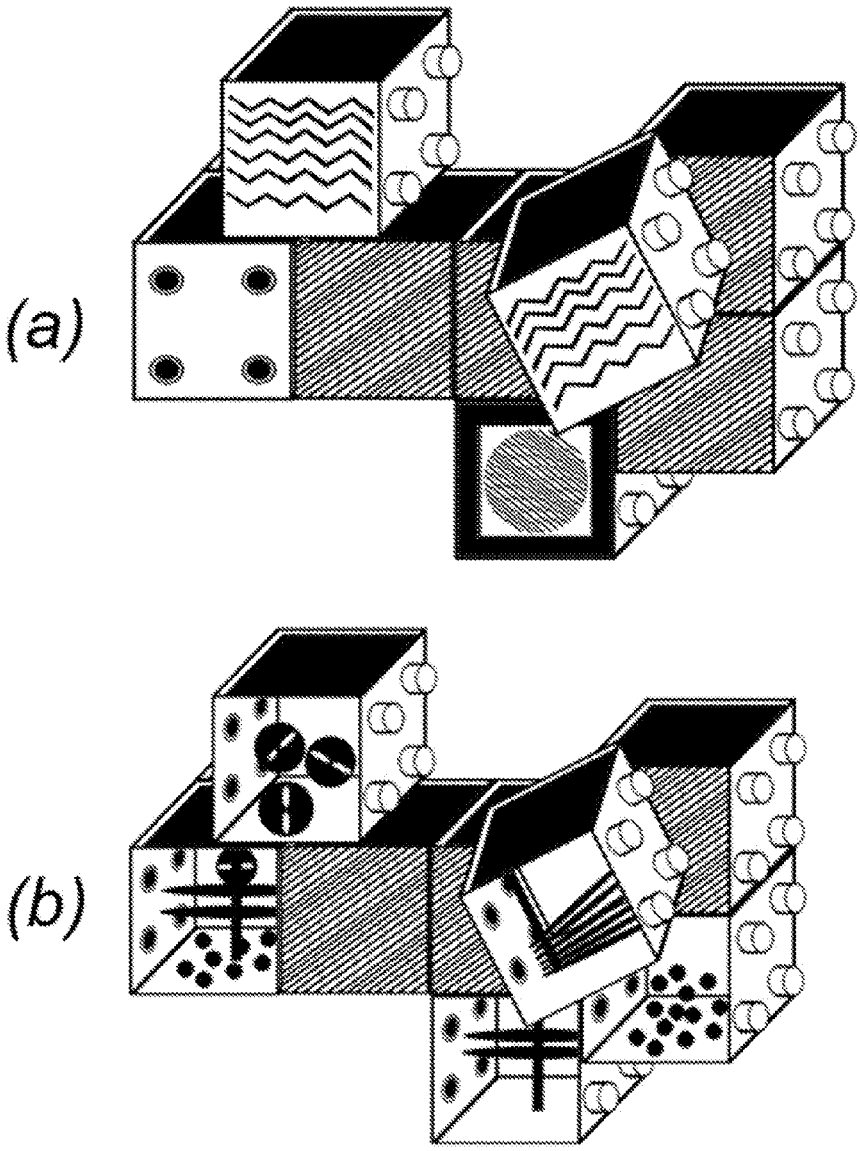
FIG. 10 shows different combination of a plurality of toy instruments.

FIG. 10 (*a-b*) shows the possibility of connecting different building blocks together to make unique and different combinations of sounds. Users can connect a plurality of building blocks together and make their own musical instrument with a unique sound that they can customize. FIG. 9 (*b*) shows the inside of some building blocks for illustration purposes.

Figure 11:
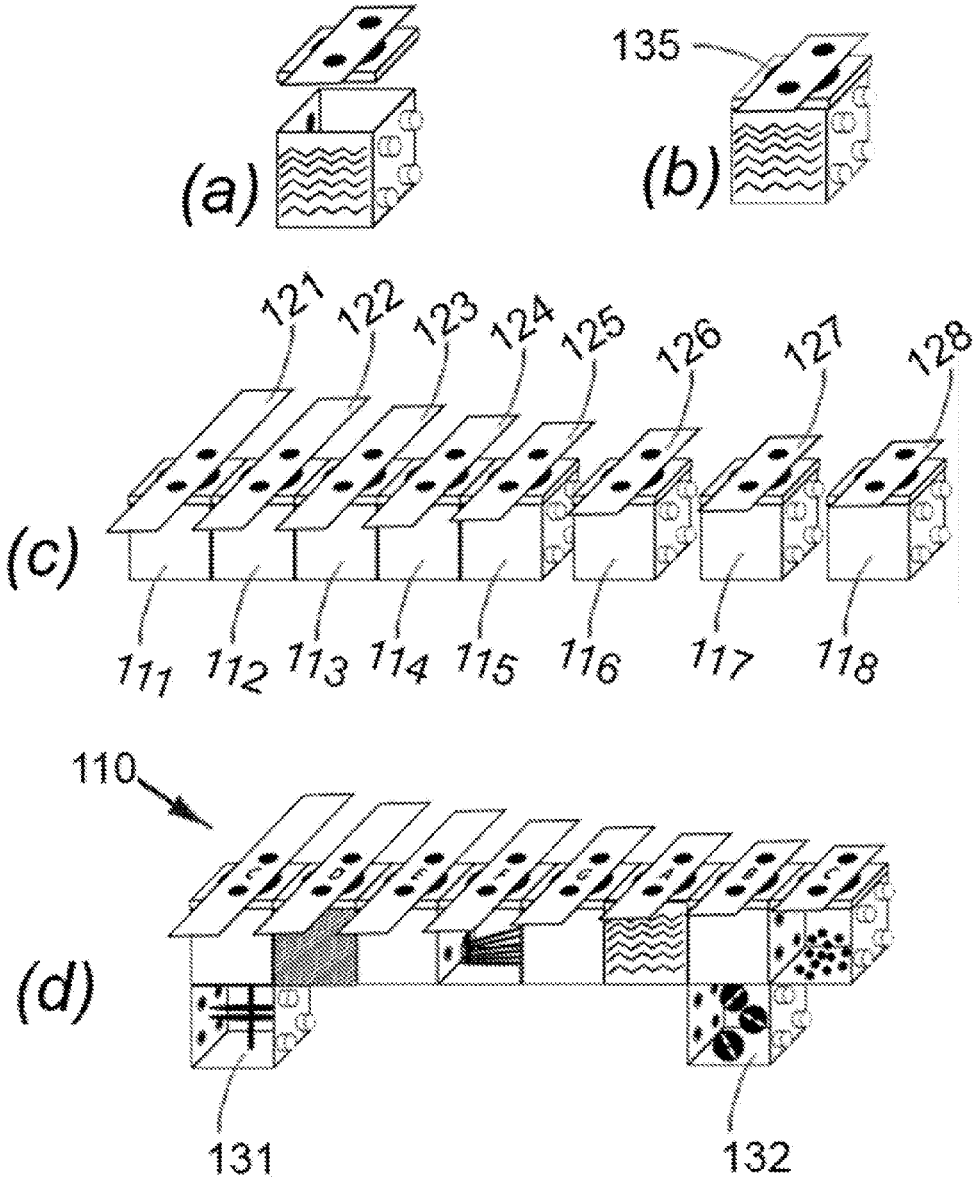
FIG. 11 shows exploded view of an example of a toy instrument with Xylophone instrument attached.

As shown in FIG. 11, the xylophone instrument 110 of the present invention comprises of a plurality of xylophone building blocks 111-118 with different bar sizes 121-128 that make higher pitched sounds to lower pitched sounds. Xylophone bars 121-128 can be mounted onto the body of the building blocks 111-118. Xylophone bars 121-128 may also be permanently installed on the building blocks 111-118 of the present invention.

The building blocks 111-118 are connected to each other by male and female connecting clips as shown in FIG. 11 (*d*).

Holes 135 may be found under xylophone bars 121-128 to help amplify sound when bars are hit. Some building blocks have shakers, bells, clackers and tambourine instruments inside the body of the building blocks, in this case when struck by a drumstick, mallet, fingers, or any other object, the bars vibrate, making a sound, further, bells, tambourine jingles, clackers and shakers vibrate and make a unique sound. As shown in FIG. 11 (*d*), the xylophone instrument 110 further has two bases 131-132 which are attached to xylophone building blocks 111-118 to help xylophone instrument 110 be stable. Elevating the xylophone assembly with bases also allows for building elements to vibrate more efficiently, allowing for better amplification of sounds when xylophone bars are hit.

Figure 12:
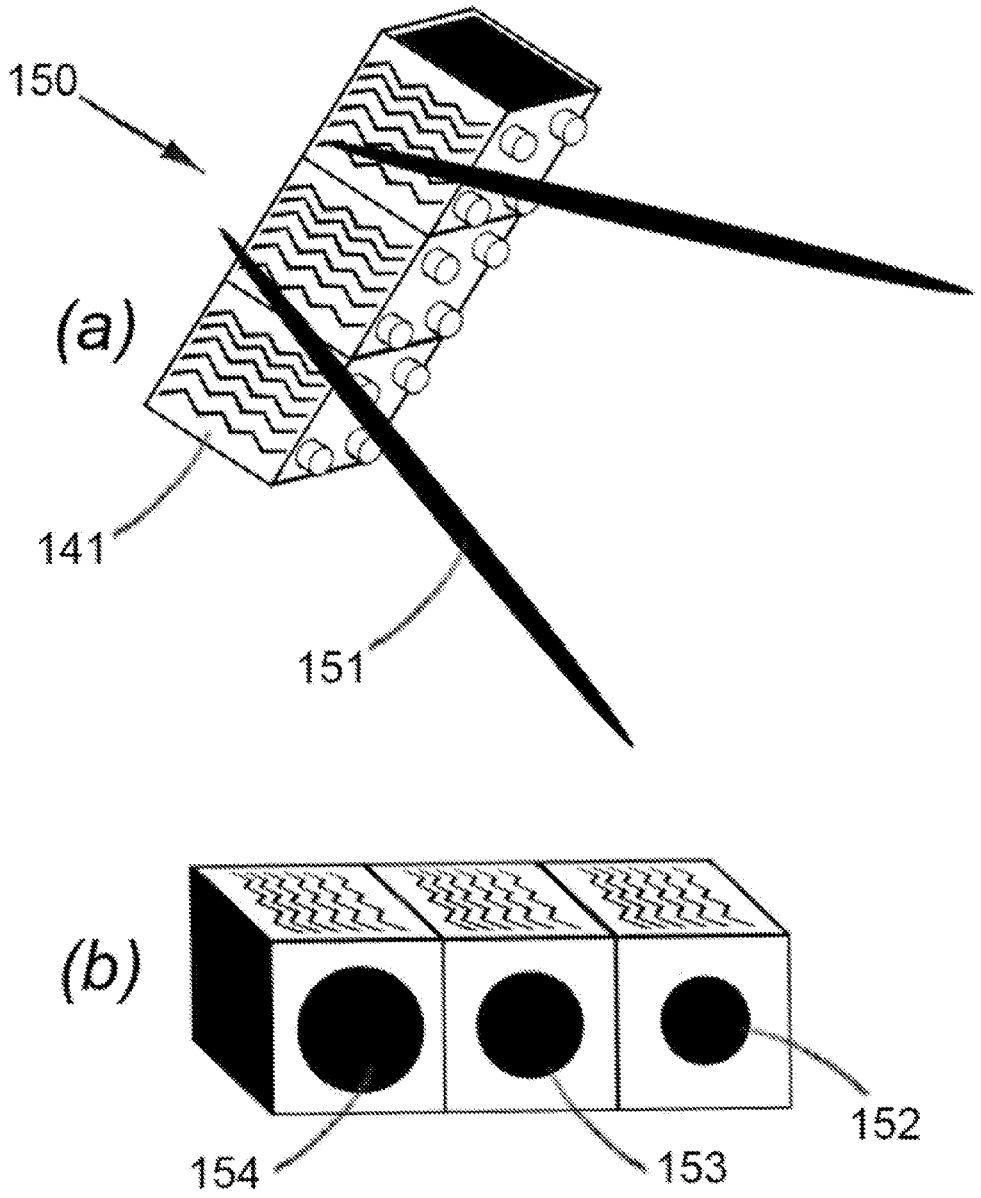
FIG. 12 shows an example of a toy instrument with Guiro and Tone-Block instrument attached.

As shown in FIG. 12, guiro building blocks 150 of the present invention are made from blocks that have notched faces 141. Sounds are made by rubbing a stick 151 on the notched faces 141, which creates a ratchet-like sound. Sounds on this instrument are amplified by holes 152, 153, and 154 on one end of the block. Sounds on this device vary depending on the spaces between the notches 141, the height of the notches 141, size of the holes 152, 153, 154, as well as the thickness and the size of the block 150 and its faces.

As shown in FIG. 12, tone-blocks of the present invention are blocks with special holes of different shapes and sizes. Hole 154, 153, and 152 vary in sizes. When the blocks are hit, they create a sound that is amplified by these holes. Holes may vary in shape. Tone-blocks may have no holes, one hole, or multiple holes. Sounds and amplification vary depending on the size of the hole and the thickness of the material of the block. Tone-blocks can be mounted onto the body of the building blocks of present invention or made within the fabric of a block.

Figure 13:
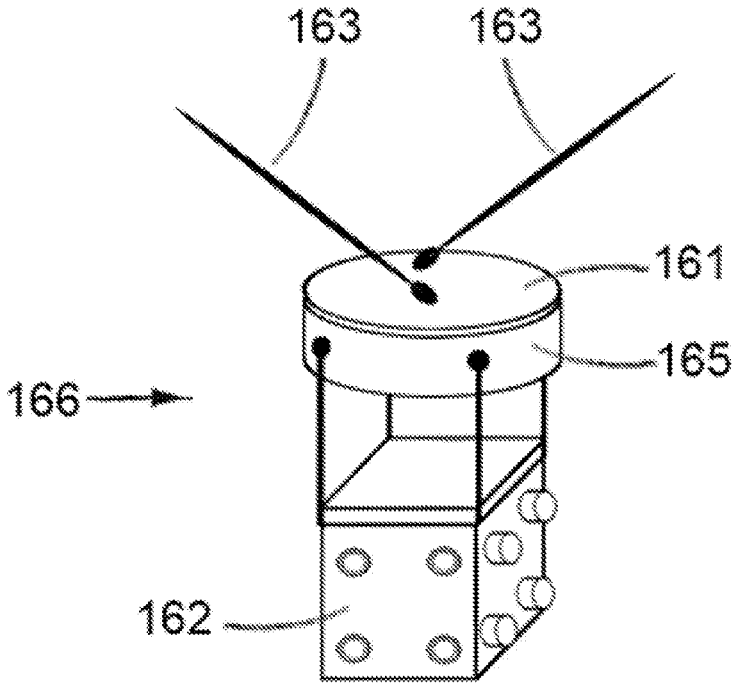
FIG. 13 shows an example of a toy instrument with Drum instrument attached.

As illustrated in FIG. 13, a drum building block 166 of the present invention is made of a drumhead 161 attached to a drum-frame 165, which is mounted to a block 162. When hit by a stick 163, hand, fingers, or any solid object, the drumhead 161 vibrates and makes a sound. Sounds change depending on how tight or loose the drumhead 161 is tightened, tuned, or fixed. Larger drums create lower sounds while smaller drums create higher sounds. Holes may be found on body of block to amplify drum sound. Drums can be mounted onto the body of the said invention or made within the fabric of a block.

Figure 14:
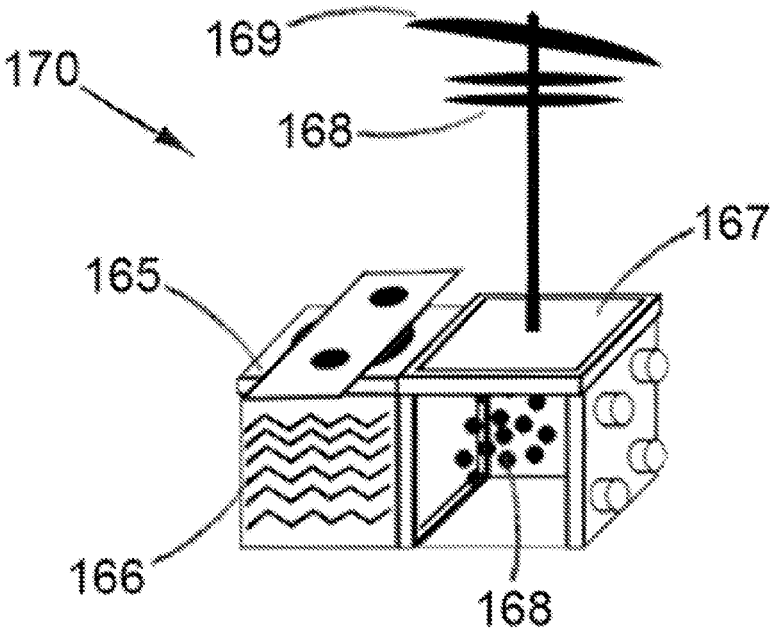
FIG. 14 shows an example of a toy instrument with Cymbal instrument attached.

As shown in FIG. 14 combination of different musical building blocks of the present invention can create a unique instrument. The xylophone building block 165 which has a notched face 166 is connected to a cymbal building block 167 which is equipped with shakers 168 inside. Jingles 168 and 169 are mounted to a block equipped with shakers.

As shown in FIG. 15, rectangular shaped building block 301 can be used to prop, support, or hold many different instruments, see FIG. 15 (*d*). Block 301 can also be used as a hand held instrument while supporting other instruments mounted to it; see FIG. 24, (901 & 904). As illustrated in FIG. 15 (*b*) shakers, or other sound making mechanisms, can found inside the body of this device.

Figure 16:
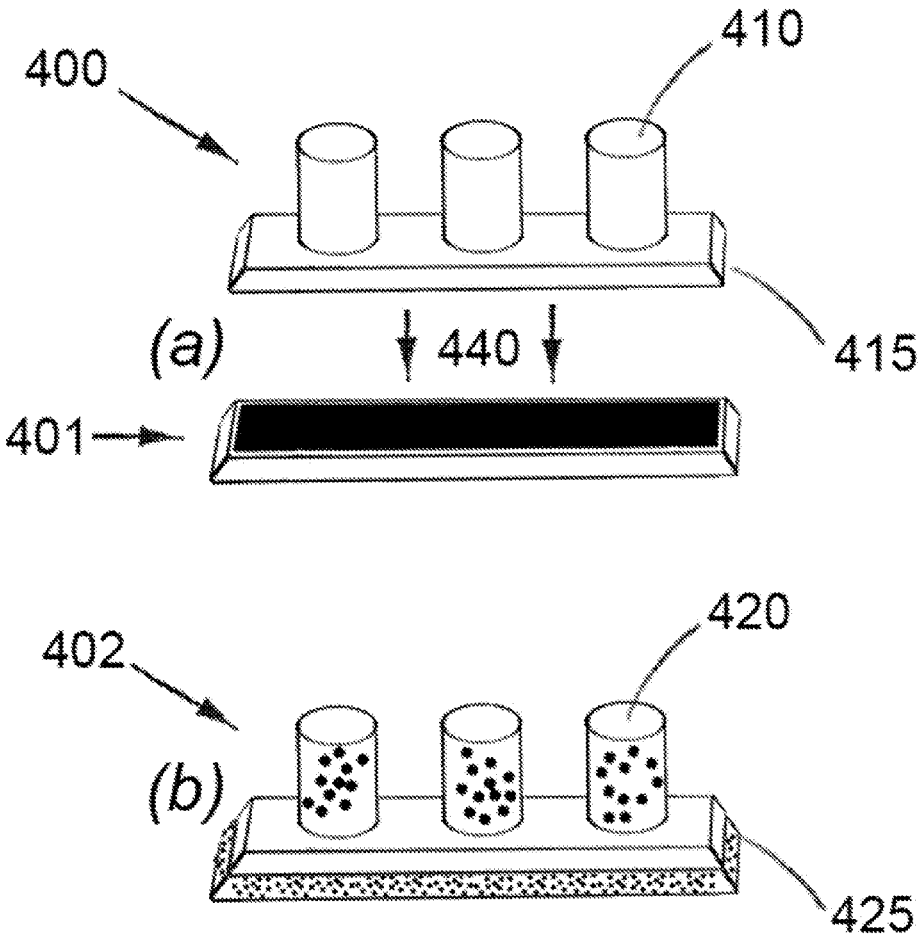
FIG. 16 shows an example of a toy instrument with cylinder shakers attached.

As shown in FIG. 16, a unique shaped musical building block 400 can mount onto a rectangular building block 301, creating one functional instrument 402. More instruments can be mounted to block cylinders 420.

Figure 17:
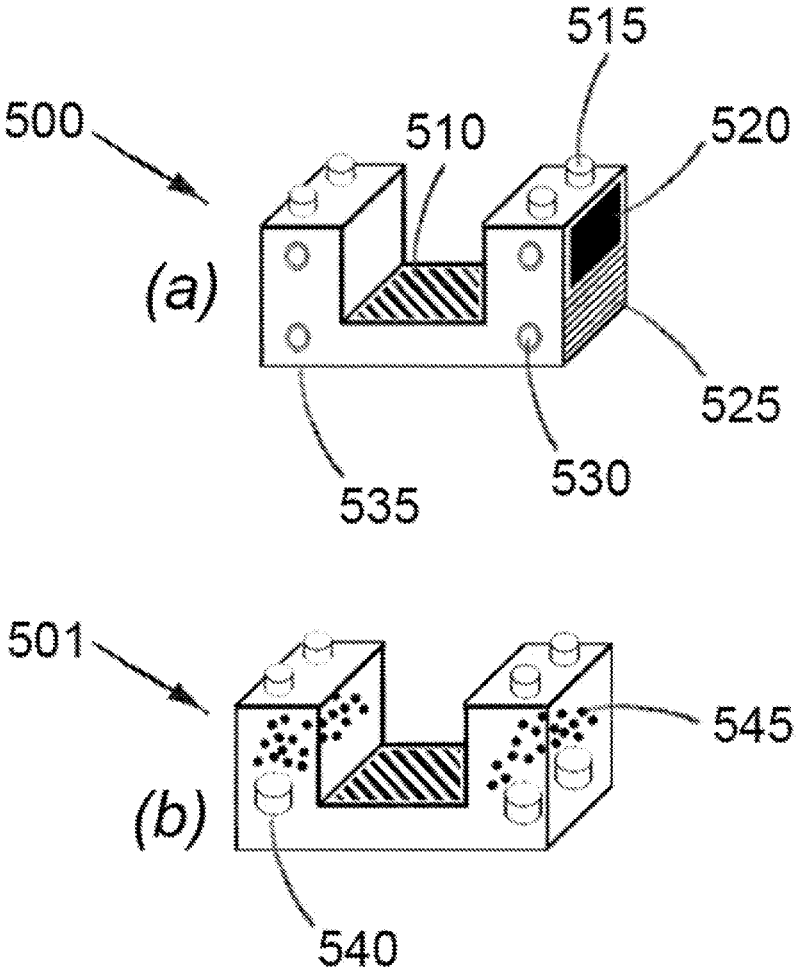
FIG. 17 shows an example of a toy block with Shakers instrument built within.

As shown in FIG. 17, musical building blocks may have unique geometric shapes. Unique shapes add to the functionality of the blocks as surface areas change, allowing more fastening options for the user and different connection methods. FIG. 17 (*a*) shows Velcro fasteners 510, clip fasteners 515, 530, & 540, magnetic fasteners 520, and unique shaped groove fasteners 525 on a single block. Unique geometrically shaped blocks of FIG. 17 may have instruments inside, example seen in FIG. 17 (*b*) where shakers 545 are built within the structure of the block.

Figure 18:
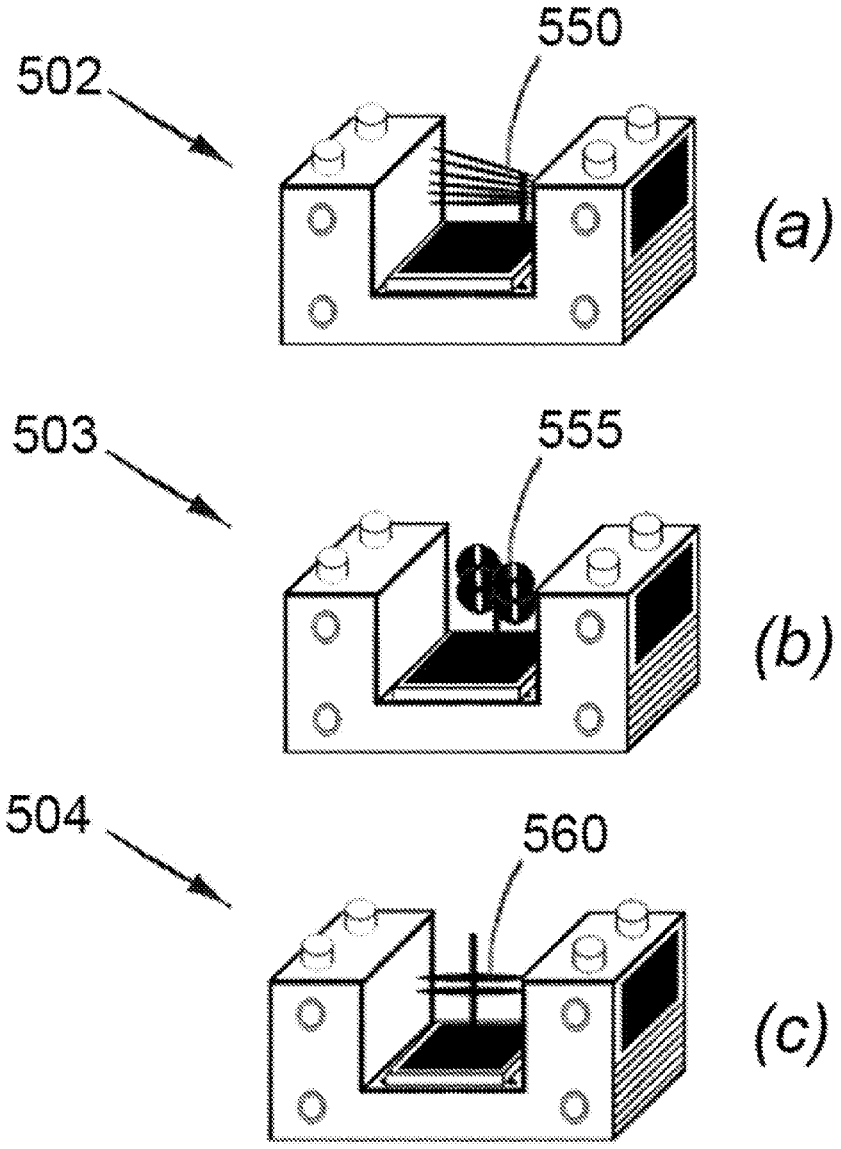
FIG. 18 shows an embodiment of a toy block with Clackers, Bells, and Tambourine instrument attached.

Uniquely shaped geometric blocks can combine a multitude of instruments. As seen in FIG. 18, (a) Clackers 550, (b) Bells 555, and (c) Tambourines 560 can be attached to these blocks.

Figure 19:
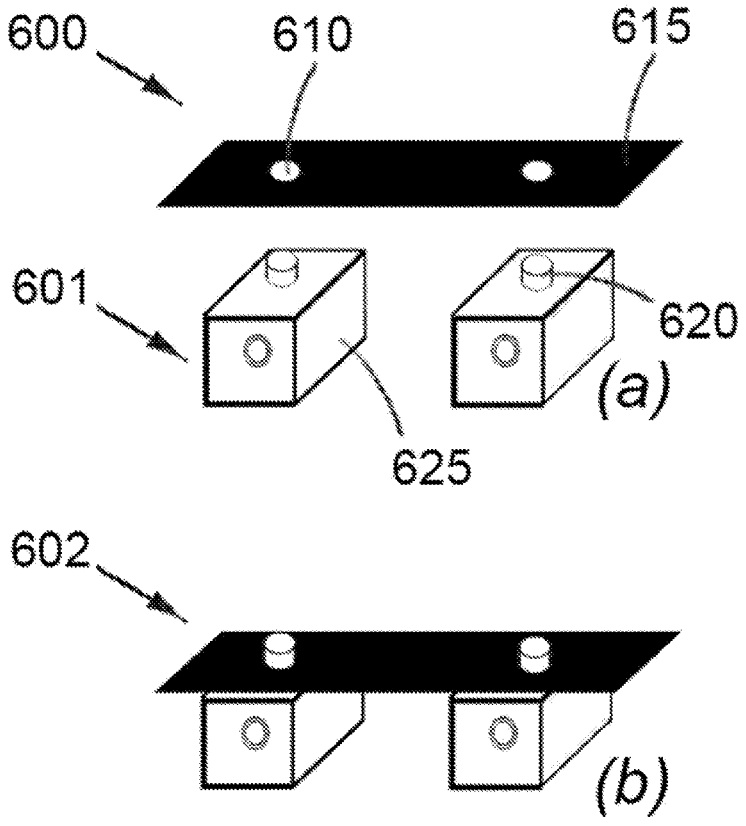
FIG. 19 shows an embodiment of a toy instrument with Xylophone attached.

As shown in FIG. 19, Xylophone bars 600 can be mounted onto the special bar holders 620 of a uniquely shaped building block. The bar holes 610 mount onto the bar holder 620 which is coated with a material such as rubber or silicon to allow for proper vibration of the bar. FIG. 19 (*b*) shows a Xylophone-bar 615 mounted onto two building blocks, creating one instrument 602.

Figure 20:
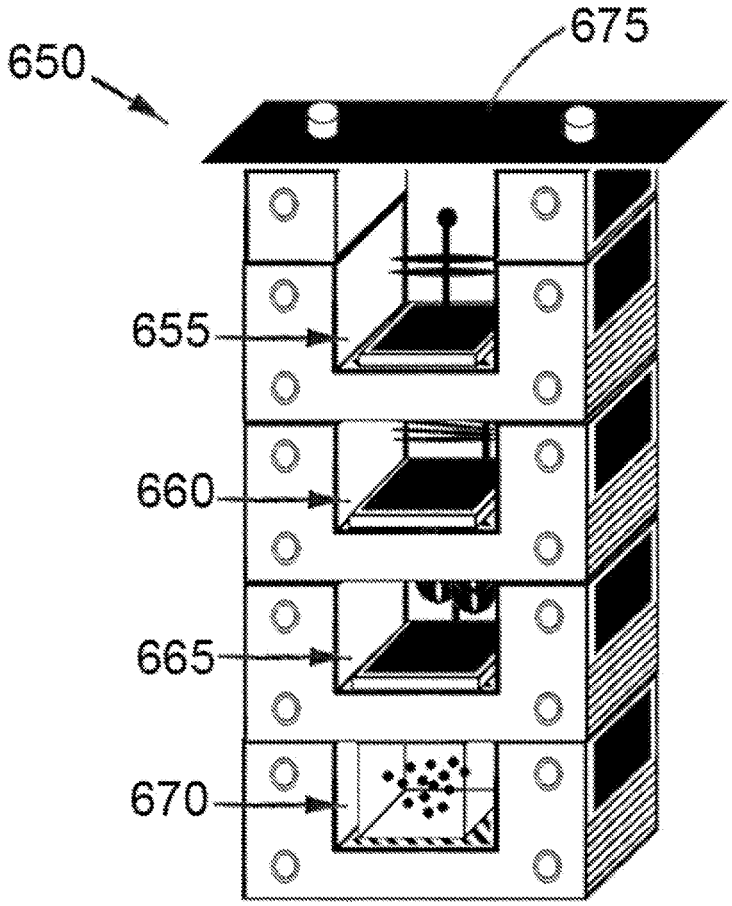
FIG. 20 shows an example of multiple toy instruments combined as one unit.

As illustrated in FIG. 20, new instruments can be made by user which combines the musical elements of a Tambourine 655, Clacker 660, Bells 665, Shaker 670, and Xylophone 675. To make sounds this new instrument can be shaken or hit by a user.

Figure 21:
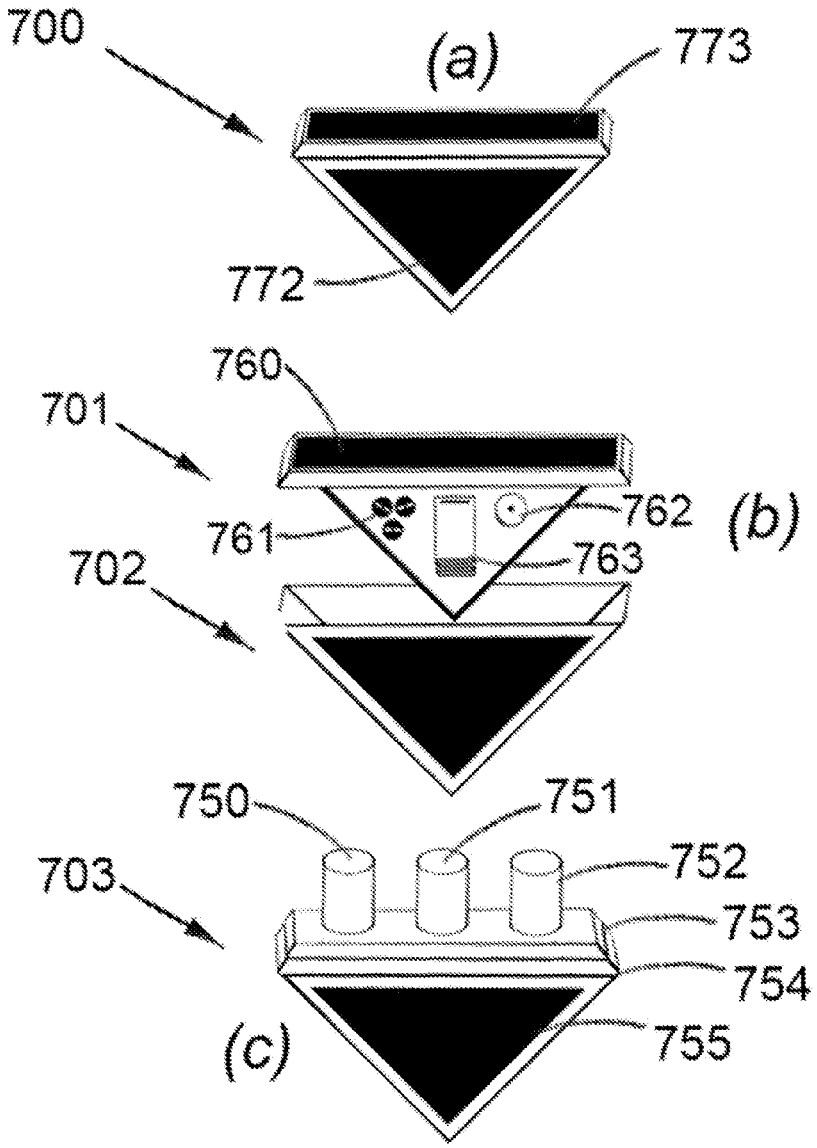
FIG. 21 shows an example of toy instruments with a triangle shape.

As shown in FIG. 21, building blocks may look like triangles, half squares or half rectangles, see FIG. 21 (*a*), while containing instruments such as Bells 761, Tambourines 762, and Clackers 763 inside, see FIG. 21 (*b*). Instruments of a triangular shaped musical building bock may be attached any part of the inner body or outer body of the block. Additional musical blocks may be attached to the outer body of the triangular block. All components making the frame of this new block may include instruments, such as shakers for example, within its body. The frame encasing musical instruments in FIG. 21 is a musical instrument when not being used as a frame.

Figure 22:
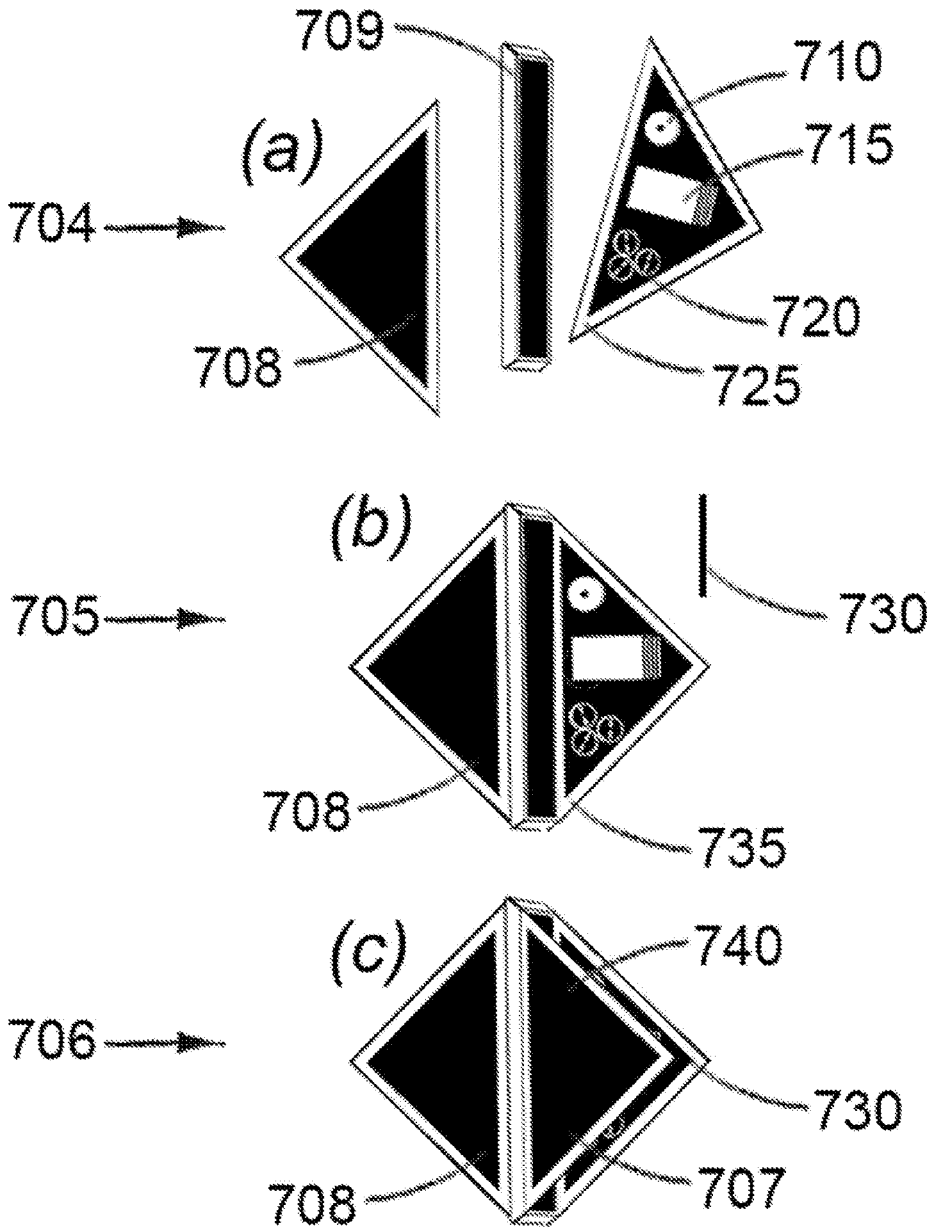
FIG. 22 shows an exploded view of toy instrument made from many musical elements.

As shown in FIG. 22, uniquely shaped blocks may be constructed out of musical and non-musical elements. The deconstructed block of 704, 705, & 706 contains triangular walls 708, rectangular walls 709, support pegs 730, Tambourines 710, Clackers 715, and Bells 720. A constructed block 706 may contain one or many musical elements within its structure, while providing a surface area 707 and 708 to attach other instruments.

Figure 23:
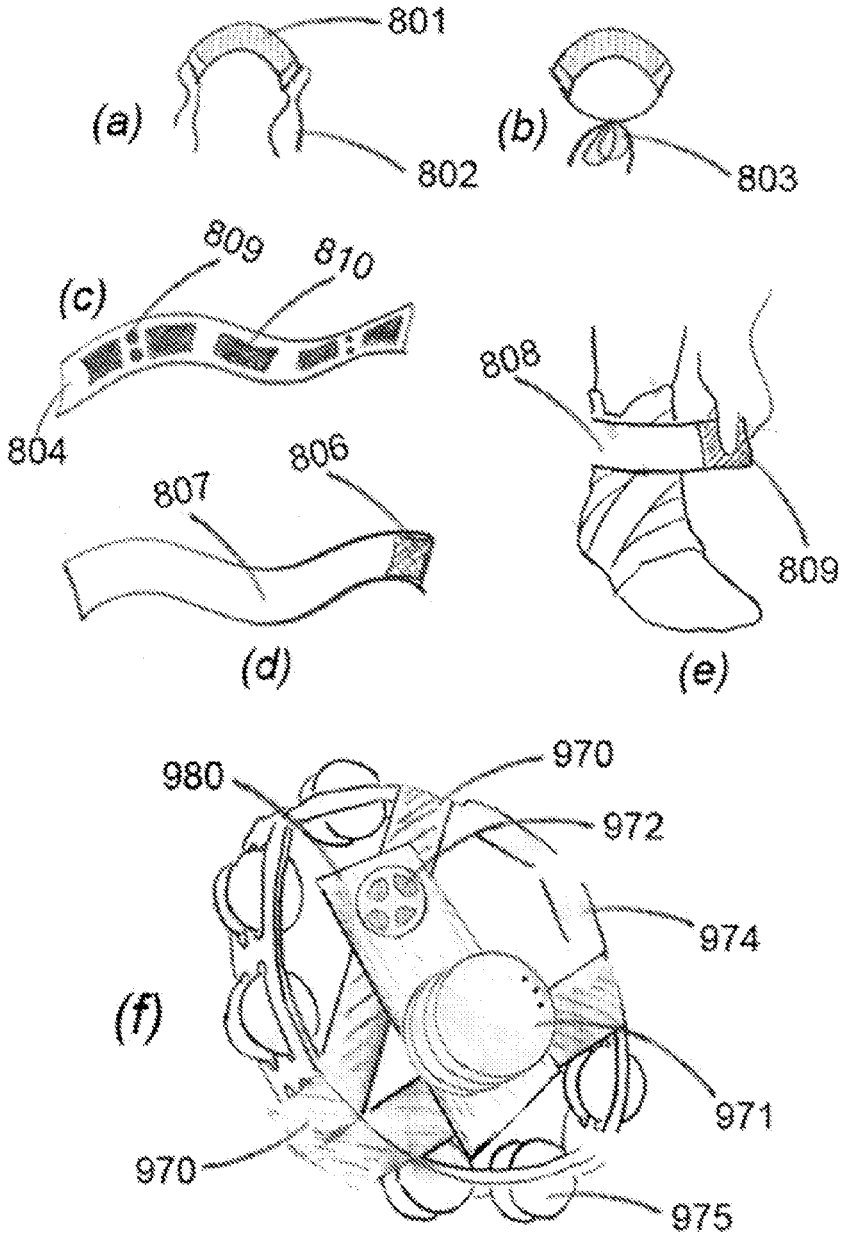
FIG. 23 shows an example of straps used to mount toy instruments to body or other instruments, tambourine instrument illustrated.

As shown in FIG. 23, instrument straps (a-d) containing Velcro 810-806, Strings 802-803, and Buttons 809. Straps can be mounted onto human limbs, as seen in FIG. 23 (*e*), or other instruments, as shown by example in FIG. 23 (*f*) where invention is mounted to a tambourine. Straps may be made of an elastic fabric or non-elastic fabric.

Straps are stretchable or non-stretchable fabrics that wrap around the user's legs, arms, knees, or elbows. Straps can also wrap around instruments, as seen in FIG. 23 (*f*). Straps latch together using Velcro, clips, latches, buttons, lace fasteners or magnets. Attachment mechanisms 809, 810, 806 are used to attach said instruments with corresponding fasteners as illustrated in FIG. 23.

Hats are a fabric worn on top of a user's head. Attachment mechanisms 844 are used to attach instruments of the present invention. Instruments 842 and 843 are illustrated in FIG. 24.

Gloves are a fabric worn on a user's hands and have attachment mechanisms 848 that are used to attach instruments of the present invention. Instruments 847, 846, 843, 845 are illustrated in FIG. 25.

Figure 26:
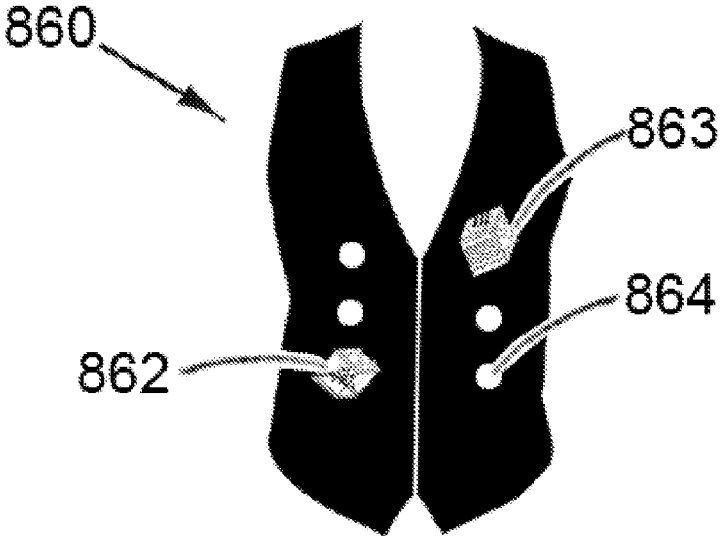
FIG. 26 shows an example of a jacket used to mount toy instruments.

Jackets are a fabric worn over user's clothing and have attachment mechanisms 864 that are used to attach instruments of the present invention. Instruments 862 & 863 are illustrated in FIG. 26.

Figure 27:
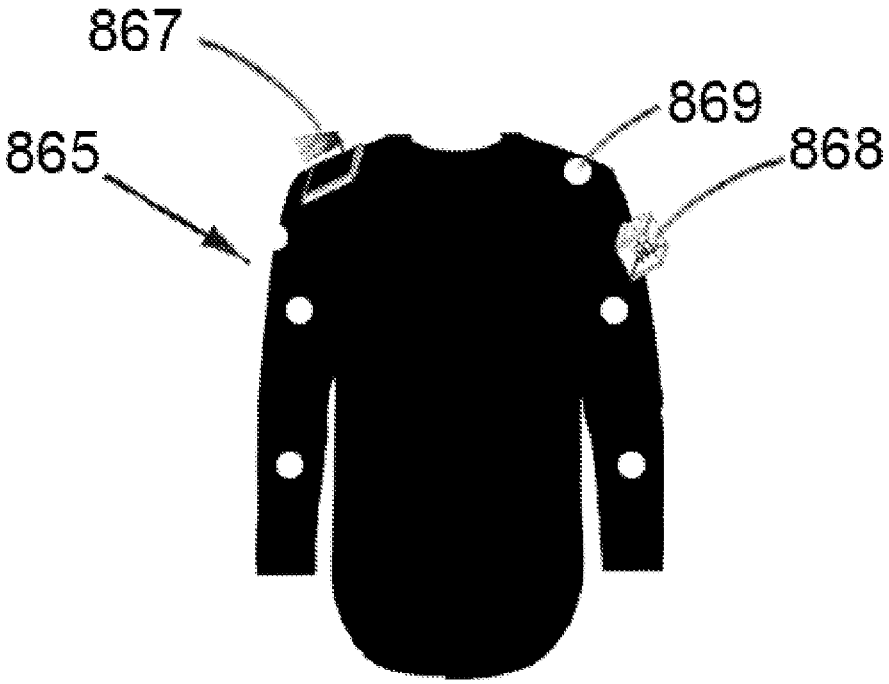
FIG. 27 shows an example of a shirt used to mount toy instruments.

Shirts are a fabric worn over a user's upper body and arms with attachment mechanisms 869 that are used to attach instruments of the present invention. Instruments 867 and 868 are illustrated in FIG. 27.

Figure 28:
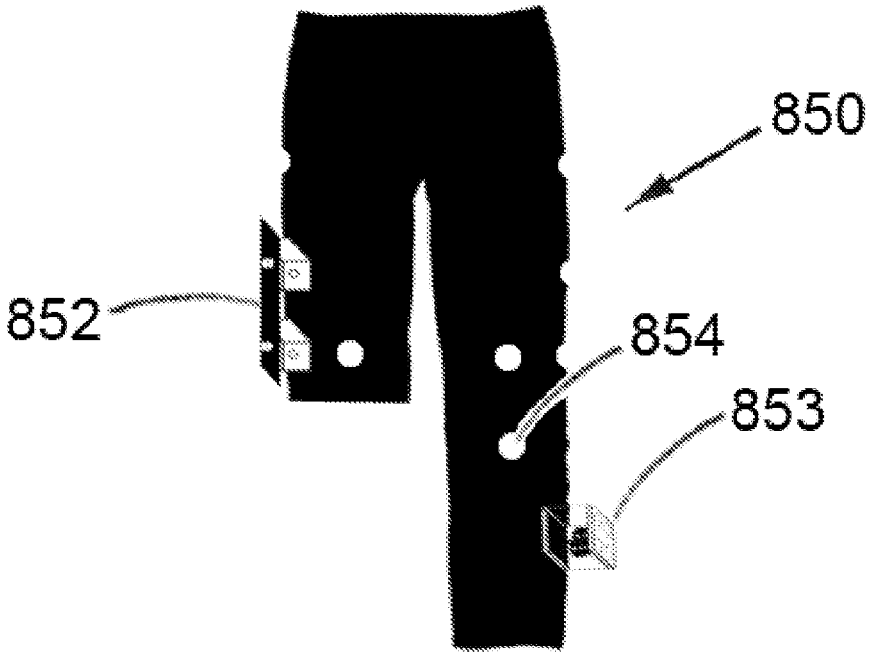
FIG. 28 shows an example of pants used to mount toy instruments.

Pants are a fabric worn over a user's legs and have attachment mechanisms 854 that are used to attach instruments of the present invention. Instruments 852 and 853 are illustrated FIG. 28.

Figure 29:
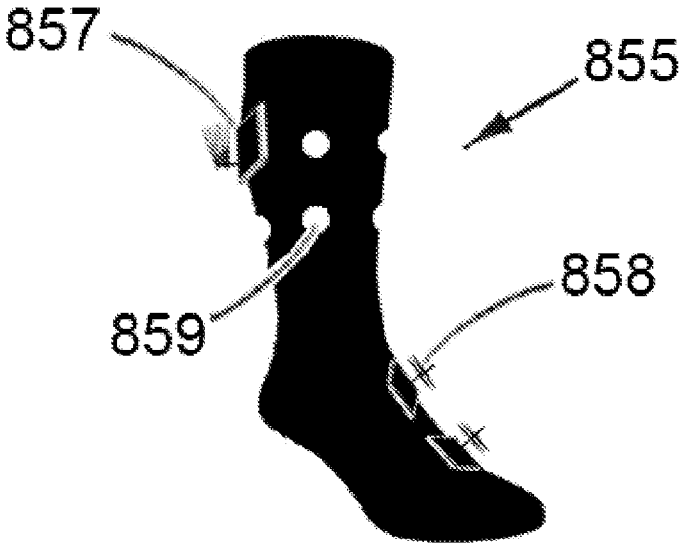
FIG. 29 shows an example of socks used to mount toy instruments.

Socks are a fabric worn over a user's feet and shins and have attachment mechanisms 859 that are used to attach instruments of the present invention. Instruments 857 and 858 are illustrated in FIG. 29.

Figure 30:
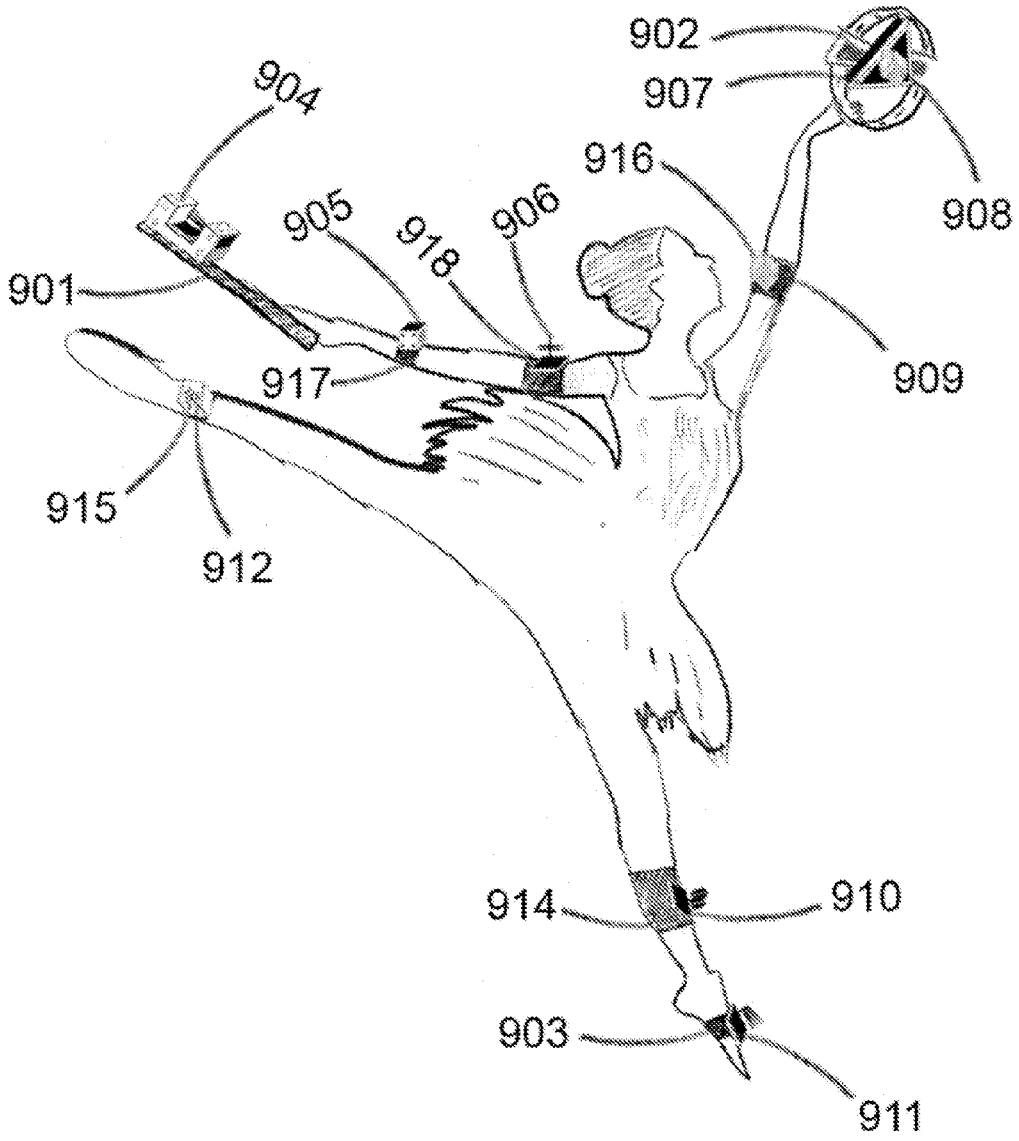
FIG. 30 shows an example of toy instruments being used by a dancer.

FIG. 30 illustrates an example of invention attached to a user who is dancing. In illustration, the user is wearing straps around foot 903, shin 914, ankle 915, wrist 917, upper-arm 918, and elbow 909. The user is holding music block 901 which has instrument 904 attached to it. The user is also holding a tambourine that has instrument-strap 902 attached to it. Further, attached to the strap is triangular-shaped-block-instrument 907, that has another block-instrument 908 attached. The user's movements will activate the instrument sounds of the present invention.

Figure 31:
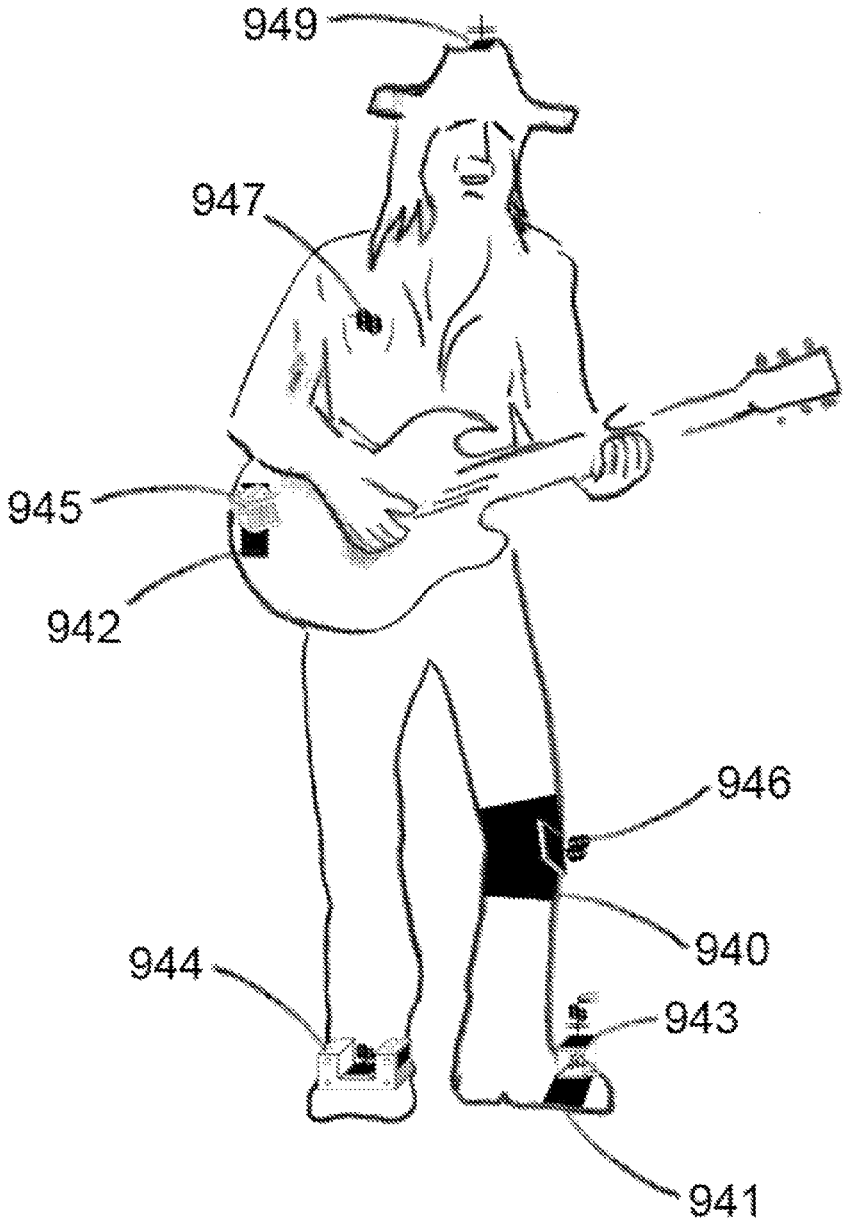
FIG. 31 shows an example of toy instruments being used by a guitarist.

FIG. 31 illustrates an example of the invention attached to a user who is playing a guitar. In the illustration, the user is wearing instrument-straps around foot 941, and knee 940. An instrument is stuck on the user's pocket 947 with clips, previously illustrated in FIG. 2 (*c*). An instrument 945 is stuck on the user's guitar that has a Velcro fasteners 942 attached. Further, an instrument 949 is attached to the user's hat. When fastening instruments to clothing, instruments are held on by clips, straps, Velcro straps, strings, or magnets. Clothing such as hats, shirts, and pants may also embody corresponding fasteners for instruments.

FIG. 1-31 show different embodiments of the present invention including different instrument arrangements, different housings for building blocks and wear ability options of the present invention. The concept of the present invention is the combining of the different musical instruments that are building elements. As shown in FIG. 1-22, shakers, cymbals, drums, xylophones, Kalimbas, tone-blocks, guiros, bells and clacker instruments embodied inside or outside the building blocks can be used to make a unique musical device with adjustable sounds. The building elements constructed make sounds by shaking, hitting, plucking, taping and are attachable to human limbs or external devices.

The material of musical toy building blocks can be selected from a group of bamboo, wood, plastics, fibreglass, copper, brass, aluminium, iron, steel, stone, recycled compounds or plant-fibre.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. Musical toy building blocks to make a plurality of combination of sounds comprising of:

a. a plurality of building blocks, each said block having four walls, a top lid and a bottom cap to make a body having an inner space;

b. at least two of said walls, said lid and said cap having releasable couplers;

c. each said block having a percussion musical instrument to produce sounds;

d. some of said blocks having different sizes, whereby larger blocks create lower pitched sounds, while smaller blocks create higher pitched sounds;

e. some of said blocks having different materials to let the instrument produce different sounds;

f. said musical instrument being mounted either onto or inside of the body of the building block, or being permanently encased within the material of a block.

2. Musical toy building blocks of claim 1, wherein one of the walls having an aperture to amplify the sound.

3. Musical toy building blocks of claim 1, wherein said musical instrument to produce a percussion sound being a xylophone instrument, wherein said xylophone being embedded on said lid and wherein each xylophone having a different bar size making higher pitched sounds to lower pitched sounds.

4. Musical toy building blocks of claim 1, wherein said musical instrument to produce a percussion sound being a tambourine, said tambourine comprising of multiple jingles having a variety of sizes, whereby a percussion sound being produced when the block being shaken.

5. Musical toy building blocks of claim 1, wherein said musical instrument to produce a percussion sound being a guiro, said guiro comprising of ridges cut into the walls or the lid, and wherein said ridges having different lengths, thicknesses and curves, whereby a percussion sound being produced by rubbing a stick over said ridges and rhythms being made by combining long and short strokes up and down of said guiro.

6. Musical toy building blocks of claim 1, wherein said bottom cap having plurality of legs, whereby said block stands on a surface on plurality of legs and vibrate when hit, allowing for a cleaner sound when using instruments that require hitting, said instrument that required hitting being selected from the groups consisting of a xylophone instrument, a guiro instrument, a cymbal instrument, a drum instrument and a tone-block.

7. Musical toy building blocks of claim 1, wherein said musical instrument to produce a percussion sound being a bell, wherein said bell being a ball shaped element contained within a metallic sphere, whereby when shaken, the ball hits the sphere, vibrating it and creating a musical sound.

8. Musical toy building blocks of claim 1, wherein said musical instrument to produce a percussion sound being clackers, said clackers comprising a series of plates with different sizes that are bound together on one end and open on the other end, whereby when shaken or moved, the open side of the plates hit each other, creating a sound.

9. Musical toy building blocks of claim 8, wherein said clackers being installed in the inner space and wherein said lid having an aperture to allow sound to travel outside the enclosed walls of the block.

10. Musical toy building blocks of claim 1, wherein said musical instrument to produce a percussion sound being kalimba, wherein said kalimba comprising of a series of pegs having different lengths mounted on a lid, said lid having an aperture, wherein one end of all pegs being fixed on said lid and the other end extends over the aperture of the lid, whereby a percussion sound is made by plucking each peg over said aperture, the vibration of the peg makes a sound and is amplified by the inner space of said block.

11. Musical toy building blocks of claim 1, wherein said musical instrument to produce a percussion sound being a shaker, said shaker comprising plurality of small loose objects placed inside the inner space of said block, and wherein said small loose objects being selected from a group consisting of beads, beans, pebbles, seeds, dried grains, and sand, whereby percussive sounds being formed by shaking said block when the objects collide with each other and the container.

12. Musical toy building blocks of claim 1, wherein said musical instrument to produce a percussion sound being cymbals, wherein said cymbals comprising of a metallic disc that are attached to the block, whereby sounds are made by hitting a single cymbal or by hitting two cymbals together, and wherein cymbals having different sizes to produce lower pitched sounds by larger cymbals and higher pitched sounds by smaller cymbals.

13. Musical toy building blocks of claim 1, wherein said musical instrument to produce a percussion sound comprising of a drumhead, wherein said drumhead being connected to the lid either directly or by a set of legs.

14. Musical toy building blocks of claim 1, wherein said musical instrument comprising of combination of clackers, bells, tambourine jingles, and shakers.

15. Musical toy building blocks of claim 1, wherein said building block material being selected from a group of bamboo, wood, plastics, fiberglass, copper, brass, aluminum, iron, steel, stone, recycled compounds or plant-fiber.

16. Musical toy building blocks of claim 1, wherein said block having a clip embedded on one said wall to attach said block to part of a clothing or a fabric.

17. Musical toy building blocks of claims 1, further having an elongated base to attach different types of musical blocks to form a hand held instrument.

18. Musical toy building blocks of claim 1, wherein said releasable couplers selected from the group consisting of male and female couplers, hook and loop couplers or magnetic connectors.

19. A Musical wearable item to make a plurality of combination of sounds comprising of:

a. a wearable item selected from the group consisting of a hat, a glove, a jacket, a shirt, a pair of pants, a pair of socks, knee and elbow covers;

b. a plurality of building blocks, each said block having four walls, a top lid and a bottom cap to make a body having an inner space, at least two of said walls, said lid and said cap having releasable couplers;

c. each said block having a percussion musical instrument to produce sounds;

d. some of said blocks having different sizes, whereby larger blocks create lower pitched sounds, while smaller blocks create higher pitched sounds;

e. some of said blocks having different materials to let the instrument produce different sounds;

f. said musical instrument being mounted either onto or inside of the body of the building block, or being permanently encased within the material of a block; and g. an attaching means to attach said building blocks to said wearable item, whereby said wearable item makes musical sound by the movement of a user.

* * * * *